US010436432B2

(12) United States Patent
Van de Ven et al.

(10) Patent No.: US 10,436,432 B2
(45) Date of Patent: Oct. 8, 2019

(54) ALUMINUM HIGH BAY LIGHT FIXTURE HAVING PLURALITY OF HOUSINGS DISSIPATING HEAT FROM LIGHT EMITTING ELEMENTS

(71) Applicant: CREE HONG KONG LIMITED, Shatin (HK)

(72) Inventors: Antony Paul Van de Ven, Sai Kung (HK); Wai Kwan Chan, Tai Po (HK); Gauss Ho Ching So, Kowloon (HK); Chin Wah Ho, Tsuen Wan (HK)

(73) Assignee: CREE, INC., Durham, NC (US)

( * ) Notice: Subject to any disclaimer, the term of this patent is extended or adjusted under 35 U.S.C. 154(b) by 83 days.

(21) Appl. No.: 13/840,887

(22) Filed: Mar. 15, 2013

(65) Prior Publication Data

US 2014/0268745 A1 Sep. 18, 2014

(51) Int. Cl.

| | |
|---|---|
| ***F21V 7/00*** | (2006.01) |
| ***F21V 29/503*** | (2015.01) |
| ***F21V 29/507*** | (2015.01) |
| ***F21V 15/01*** | (2006.01) |
| ***F21V 23/00*** | (2015.01) |

(Continued)

(52) U.S. Cl.

CPC ..... *F21V 29/507* (2015.01); *F21V 15/01* (2013.01); *F21V 23/008* (2013.01); *F21V 29/74* (2015.01); *F21Y 2115/10* (2016.08)

(58) Field of Classification Search

CPC ... F21S 8/081; F21S 2/005; F21S 8/04; F21V 1/00; F21V 7/0025; F21V 7/0083; F21V 23/006; F21V 23/009; F21V 13/02; F21V 13/10; F21V 11/00; F21V 15/01; F21V 17/06; F21V 19/0035; F21V 23/005; F21V 29/004; F21Y 2101/02; F21Y 2105/001; F21Y 2111/001; F21Y 2111/005; F21Y 2103/10; F21Y 2105/10; F21K 9/20

USPC ..... 362/218, 235, 249.01, 236, 248, 249.02, 362/264, 294, 296.01, 310, 345, 346, 373, 362/477, 540, 545–547, 650

See application file for complete search history.

(56) References Cited

U.S. PATENT DOCUMENTS 4,231,080 A * 10/1980 Compton ..... 362/298
6,428,189 B1 8/2002 Hochstein ..... 362/227

(Continued)

OTHER PUBLICATIONS

Cree® XLamp® CXA2530 LED Product Family Data Sheet, 15 pages.

(Continued)

*Primary Examiner* — Ismael Negron

(74) *Attorney, Agent, or Firm* — Ferguson Case Orr Paterson LLP

(57) ABSTRACT

Aluminum high bay lighting fixtures a primary housing; at least one secondary housing partially surrounding a primary housing; a plurality of light emitting elements in thermal contact with the primary housing; a heat spreader plate in thermal contact with the light emitting elements and the primary and secondary housings. At least one of the primary and secondary housings include openings to help dissipate heat from the light source and/or allow at least some of the light from the light emitting elements to be outputted in a direction opposite the main light emitting direction. The shortest distance from a distal end of the primary housing to the light sources is greater than the shortest distance from a distal end of the secondary housing to the light sources.

53 Claims, 20 Drawing Sheets

(51) Int. Cl.
*F21V 29/74* (2015.01)
*F21Y 115/10* (2016.01)

(56) References Cited

U.S. PATENT DOCUMENTS

| | | | | |
|---|---|---|---|---|
| 7,044,620 | B2 | 5/2006 | Van Duyn | 362/227 |
| 7,441,925 | B2 | 10/2008 | Chou | 362/249.01 |
| 7,771,087 | B2 | 8/2010 | Wilcox | 362/183 |
| 7,794,124 | B2 * | 9/2010 | Hulsey et al. | 362/477 |
| 7,824,070 | B2 | 11/2010 | Higley | 362/249.02 |
| 7,936,561 | B1 | 5/2011 | Lin | 165/185 |
| 8,104,929 | B2 * | 1/2012 | Kovalchick et al. | 362/294 |
| 8,186,852 | B2 * | 5/2012 | Dassanayake et al. | 362/249.02 |
| 8,388,197 | B1 * | 3/2013 | Huang et al. | 362/373 |
| 8,471,443 | B2 * | 6/2013 | Choi et al. | 313/45 |
| 8,602,579 | B2 * | 12/2013 | Van de Ven et al. | 362/96 |
| 8,602,598 | B2 * | 12/2013 | Duan et al. | 362/294 |
| 8,692,444 | B2 * | 4/2014 | Patel et al. | 313/46 |
| 8,708,522 | B2 | 4/2014 | Wang | 362/235 |
| 9,441,634 | B2 | 9/2016 | Spiro | |
| 9,939,143 | B2 | 4/2018 | Spiro | |
| 2004/0175189 | A1 | 9/2004 | Weber-Rabsilber | 398/201 |
| 2009/0068856 | A1 | 3/2009 | Low | 439/56 |
| 2011/0110084 | A1 * | 5/2011 | Moon et al. | 362/248 |
| 2011/0204780 | A1 | 8/2011 | Shum | 315/35 |
| 2012/0300461 | A1 * | 11/2012 | Lynch et al. | 362/249.02 |
| 2013/0039056 | A1 * | 2/2013 | Cho et al. | 362/235 |

OTHER PUBLICATIONS

Office Action from U.S. Appl. No. 14/145,559; dated Mar. 8, 2016.
Office Action from U.S. Appl. No. 14/145,559; dated Jun. 23, 2016.
Office Action for U.S. Appl. No. 14/145,355: dated Oct. 18, 2016.
Office Action for U.S. Appl. No. 14/145,355; dated May 31, 2017.
Office Action for U.S. Appl. No. 14/145,559; dated Jun. 7, 2017.
Office Action for U.S. Appl. No. 14/145,355; dated Mar. 27, 2018.
Office Action for U.S. Appl. No. 14/145,559; dated Apr. 18, 2018.

* cited by examiner

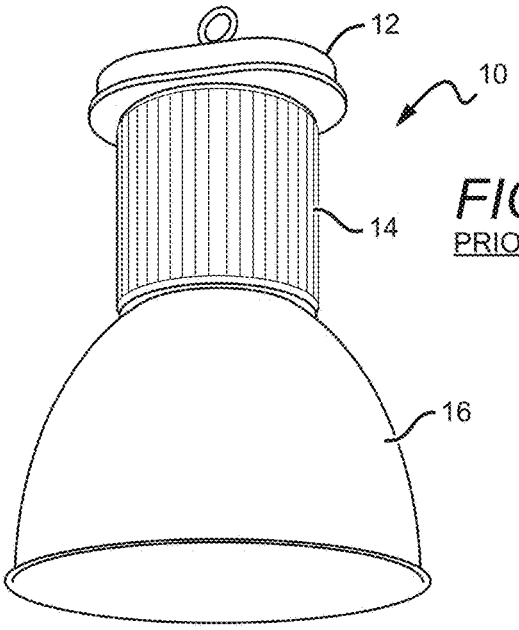
FIG. 1
PRIOR ART
FIG. 2
PRIOR ART
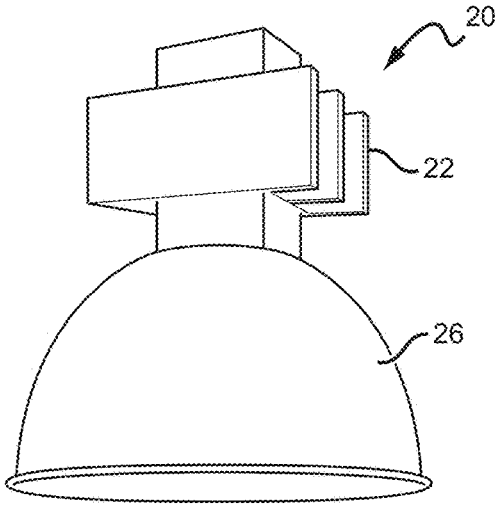
FIG. 3
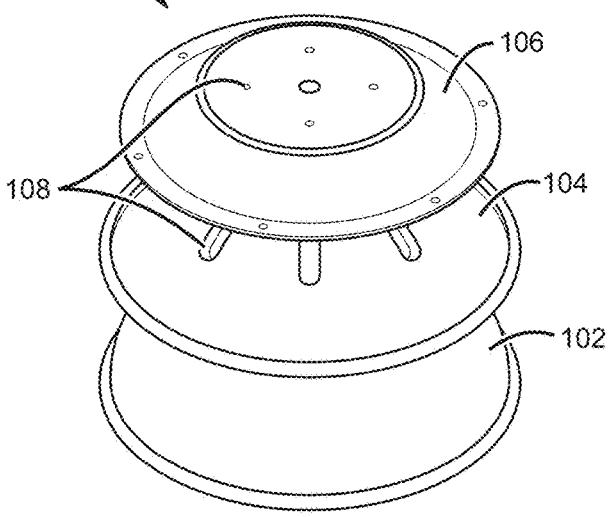

FIG. 6
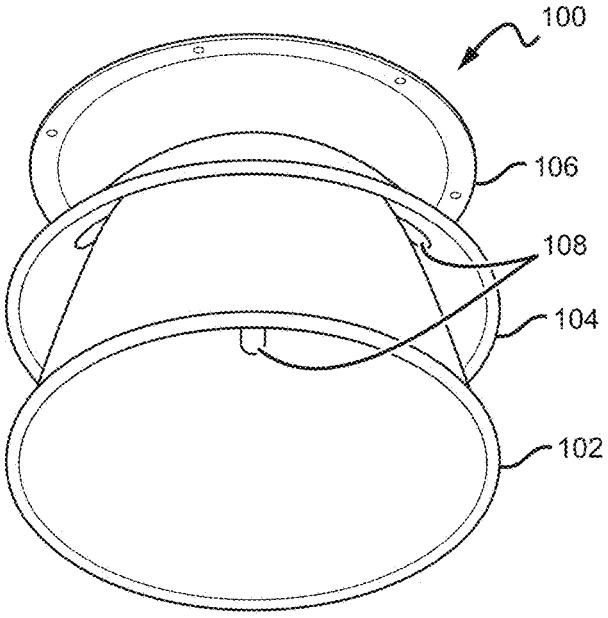
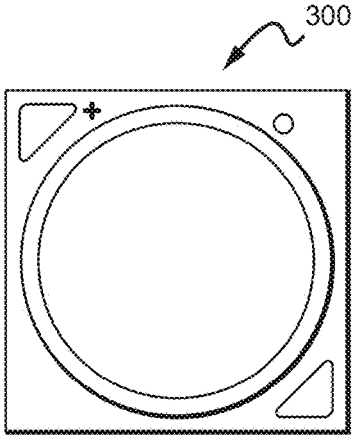
FIG. 8
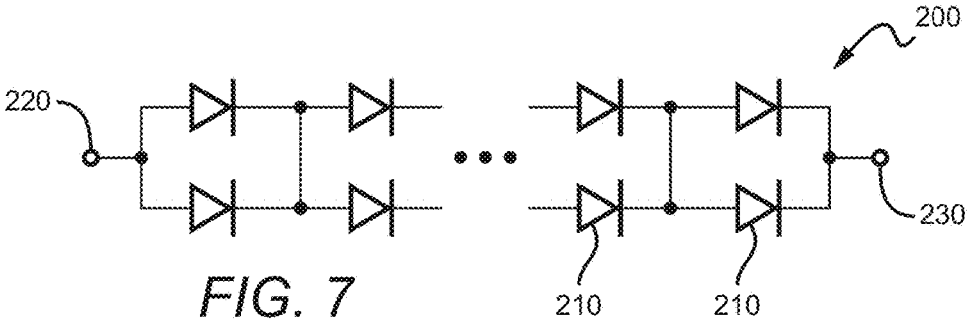
FIG. 7
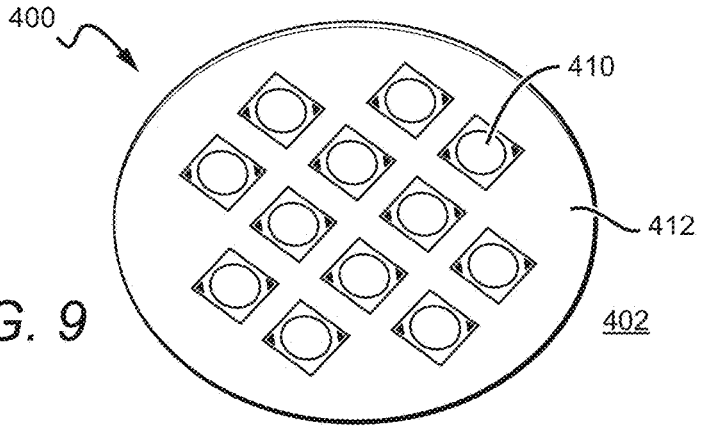
FIG. 9

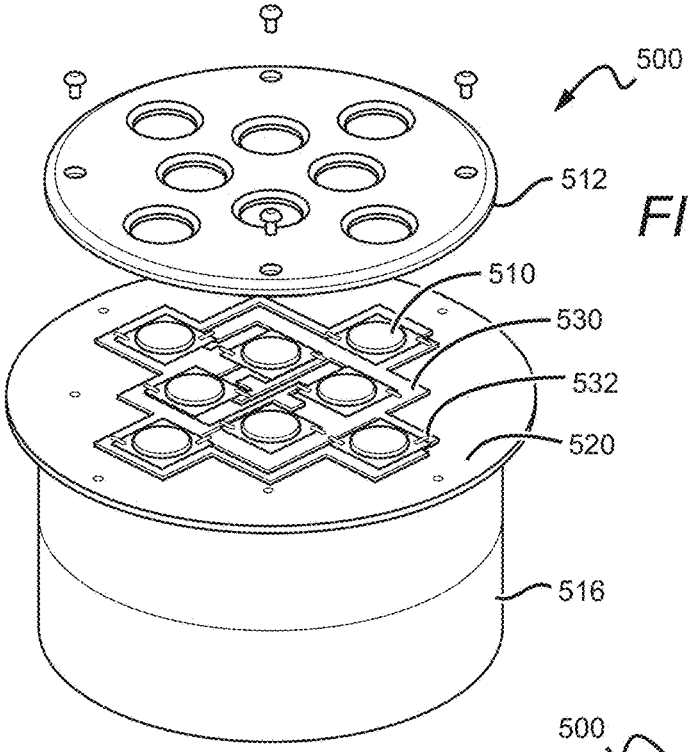
FIG. 10
FIG. 10A
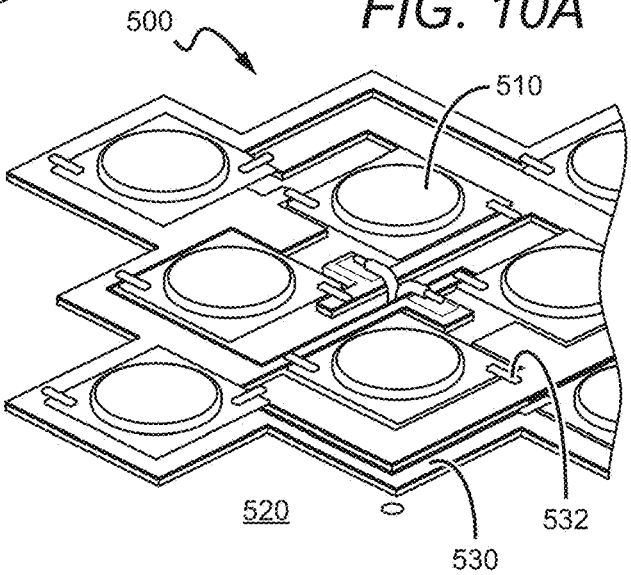
FIG. 10B
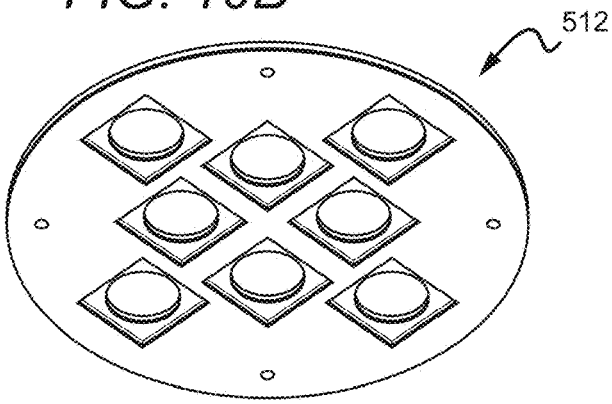

FIG. 11
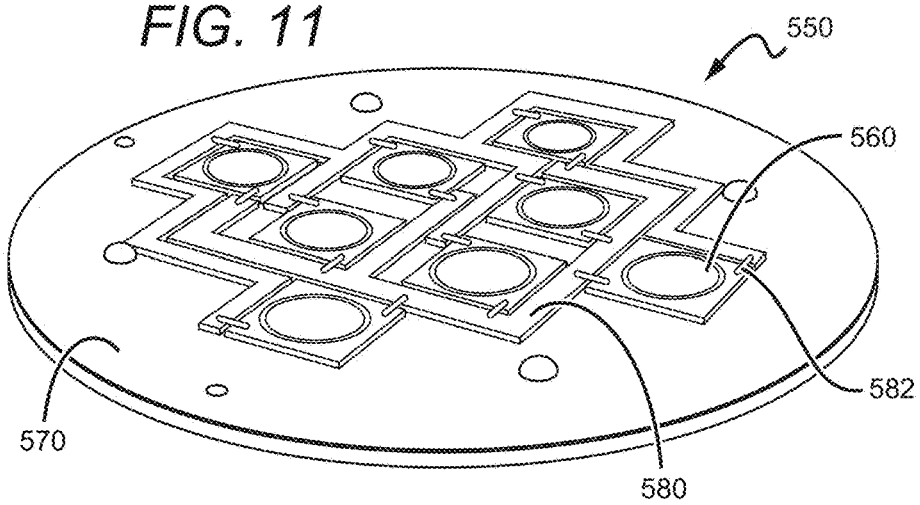
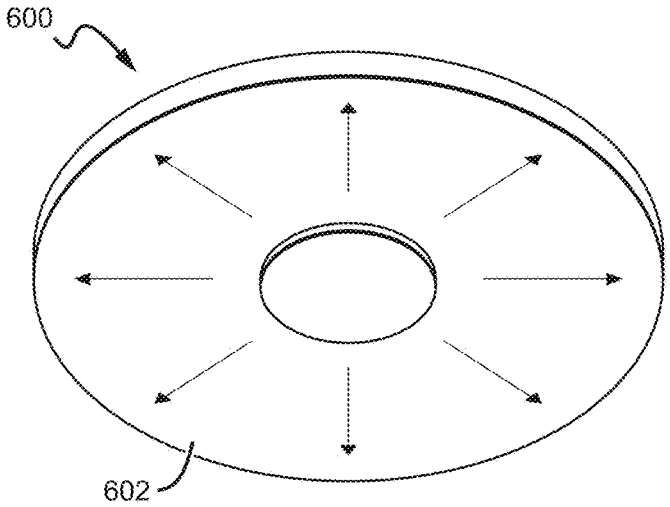
FIG. 12
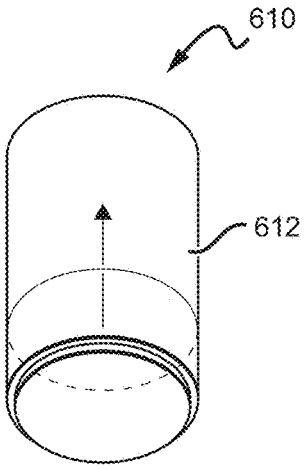
FIG. 13
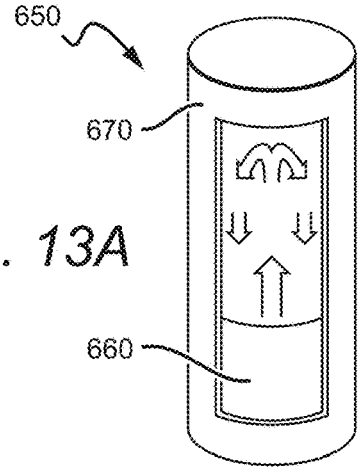
FIG. 13A

FIG. 14
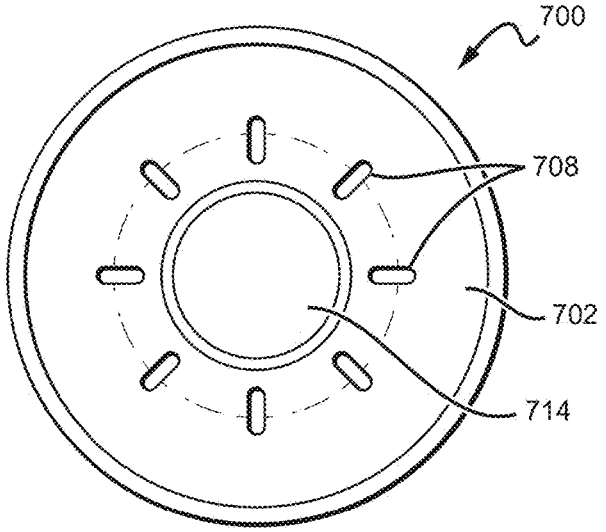
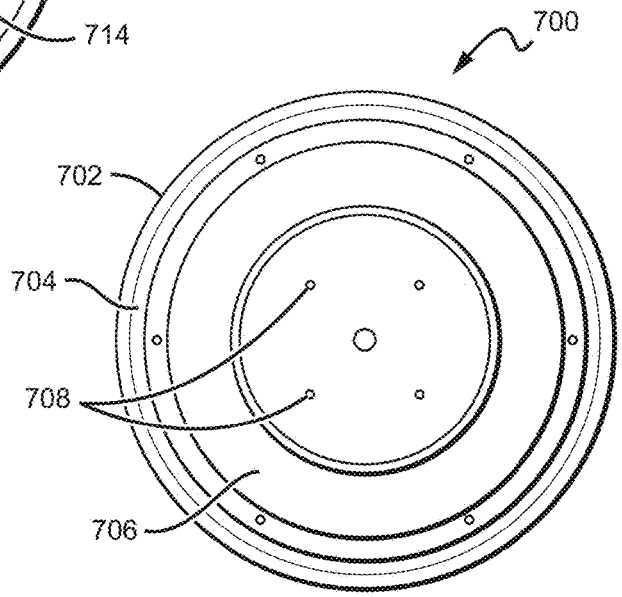
FIG. 15
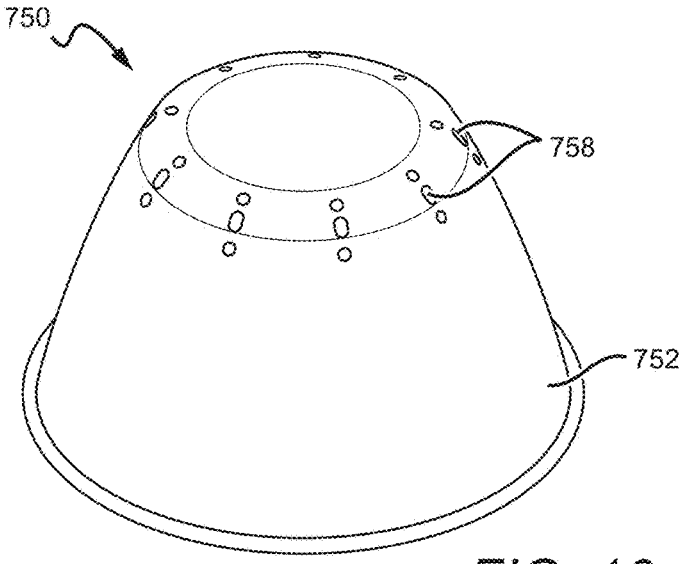
FIG. 16

FIG. 24
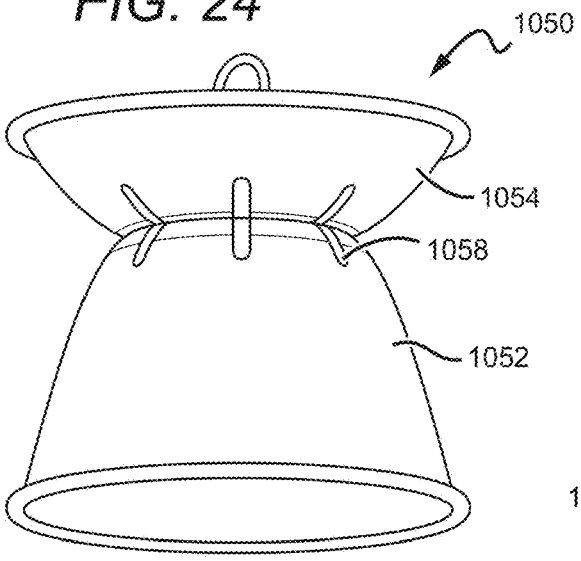
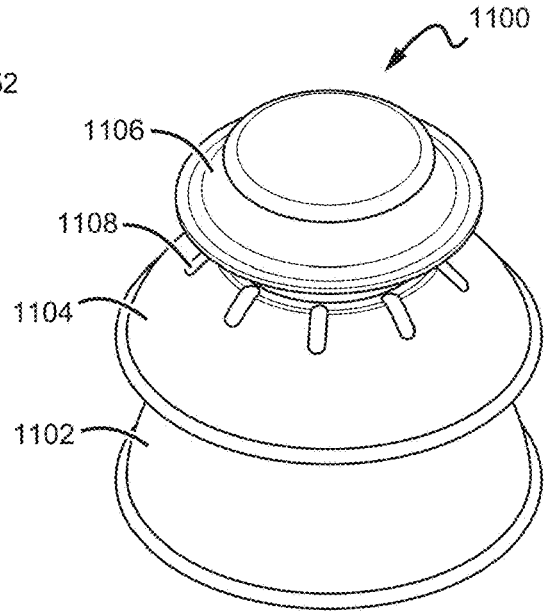
FIG. 25
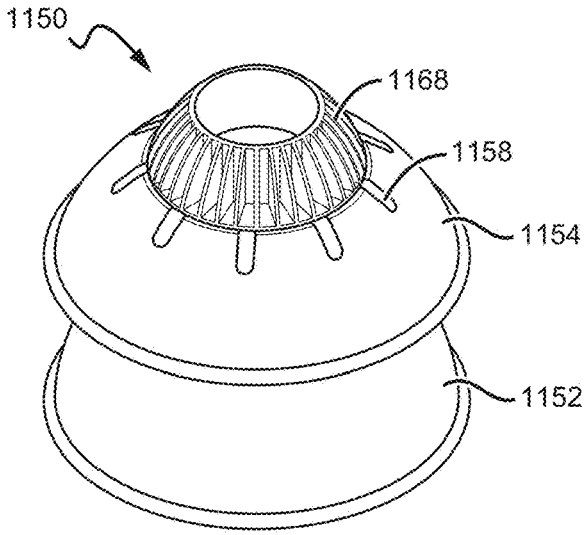
FIG. 26
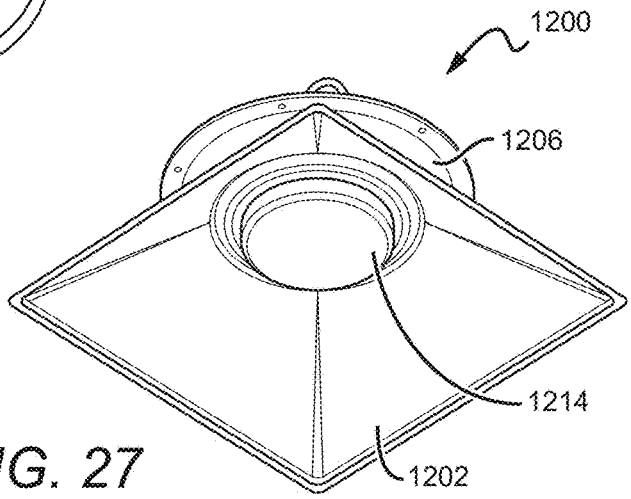
FIG. 27

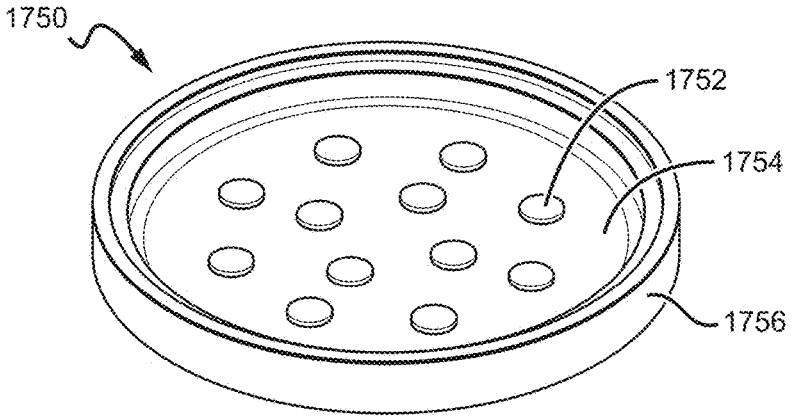
FIG. 35A
FIG. 35B
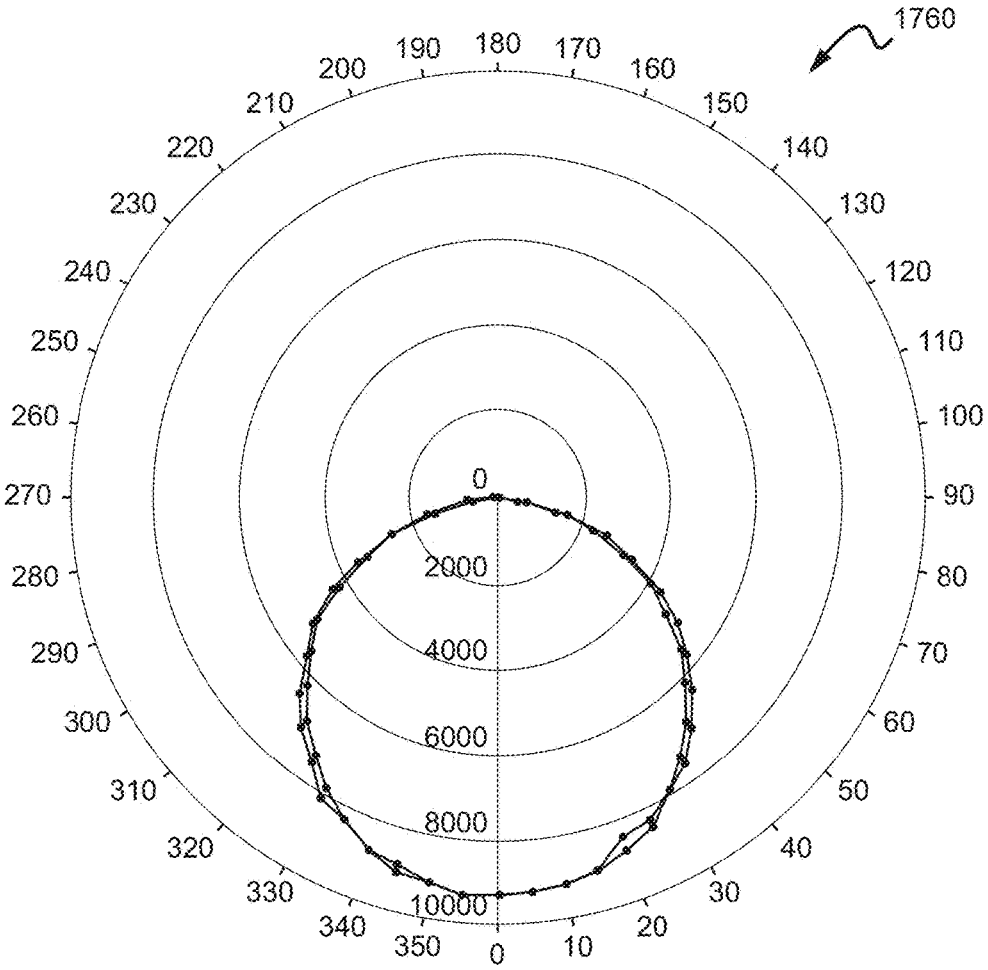

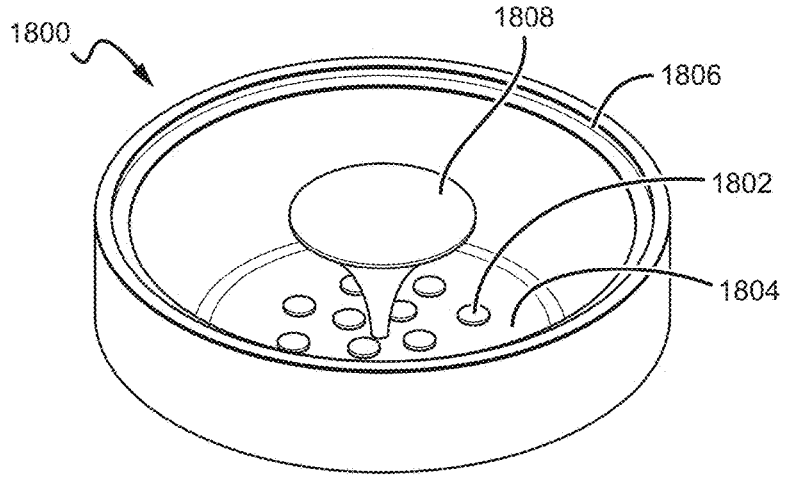
FIG. 36A
FIG. 36B
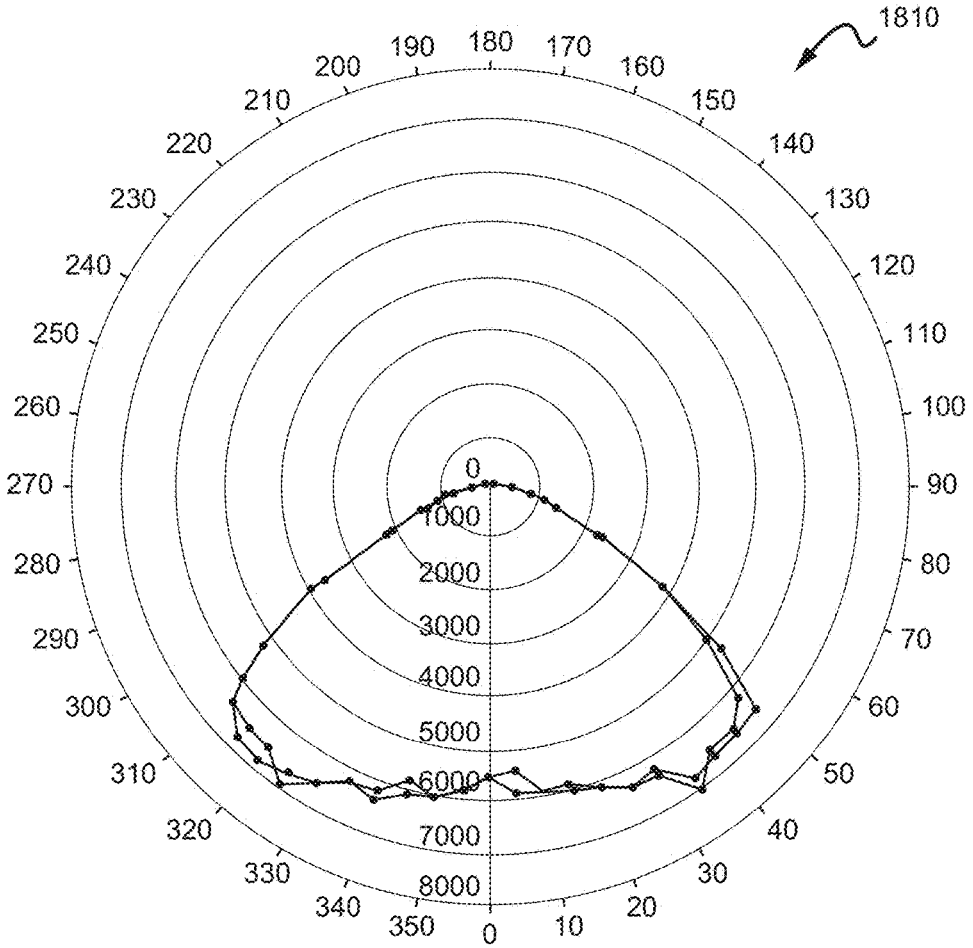

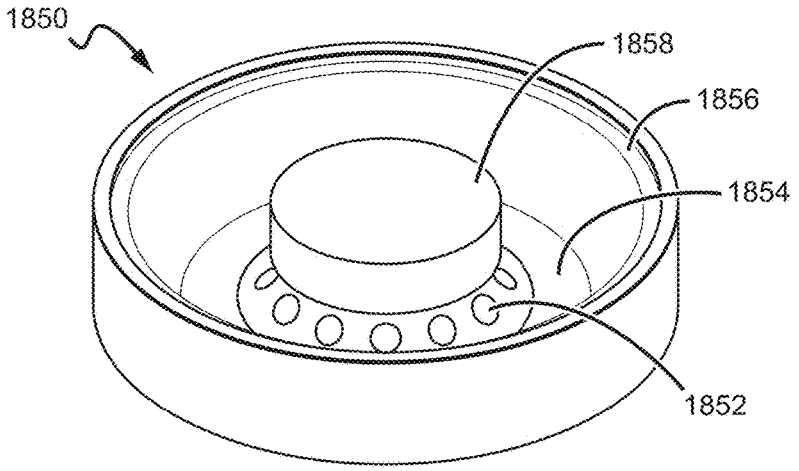
FIG. 37A
FIG. 37B
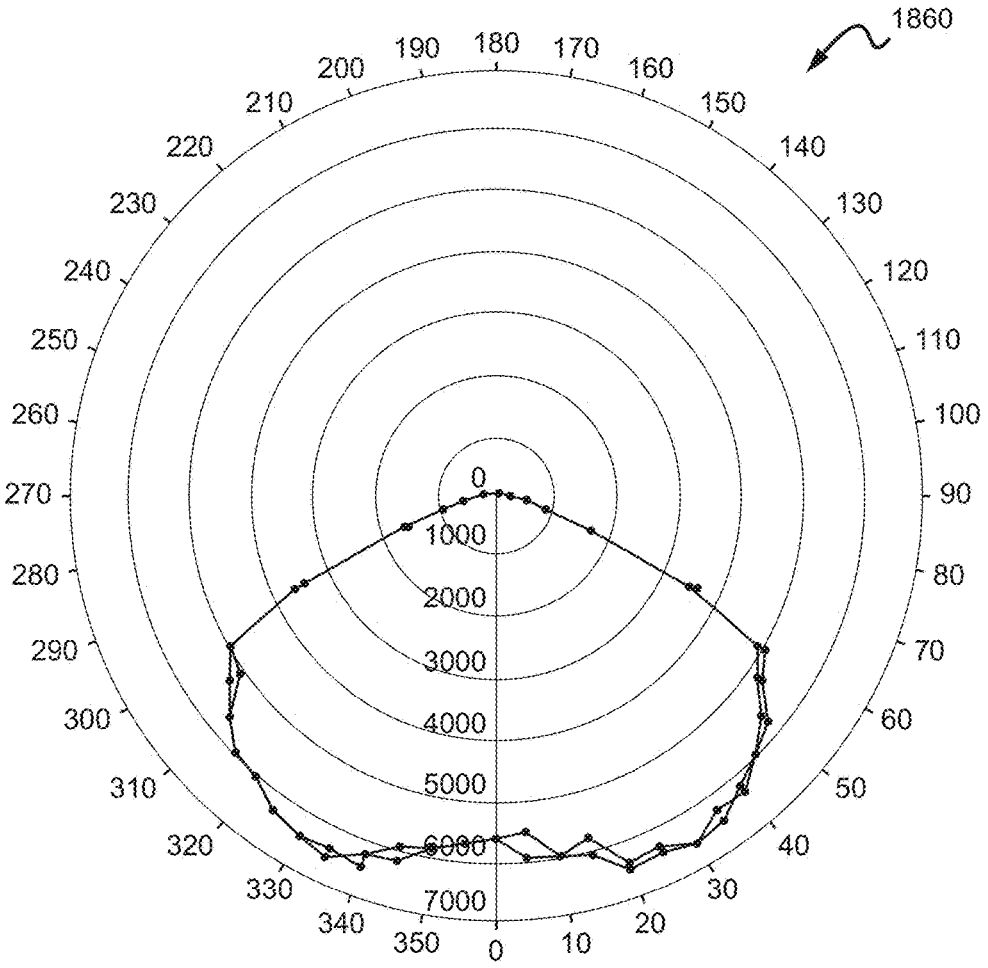

FIG. 38
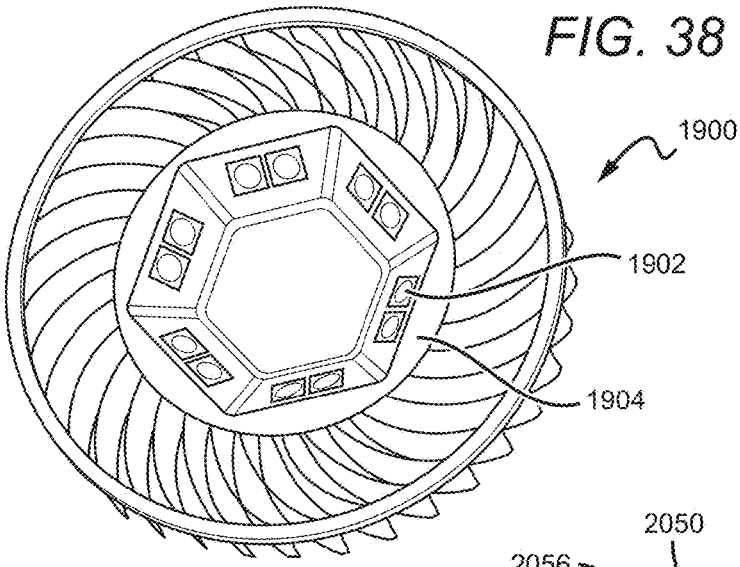
FIG. 39
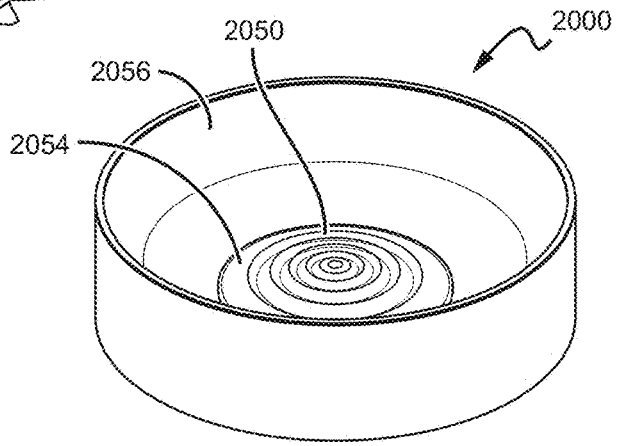
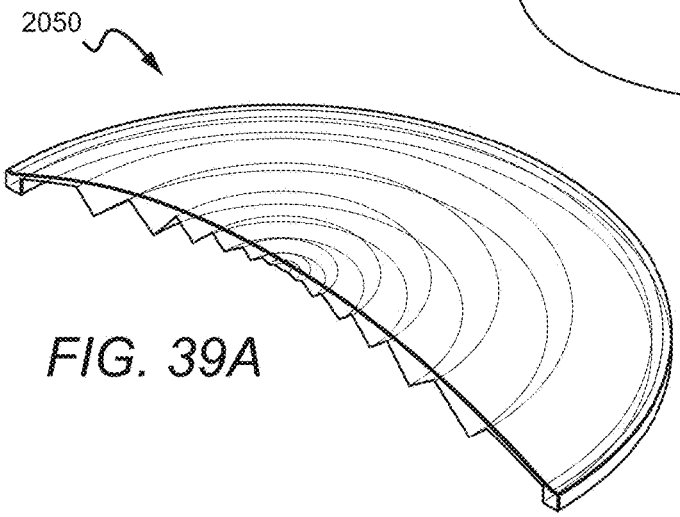
FIG. 39A
FIG. 39B
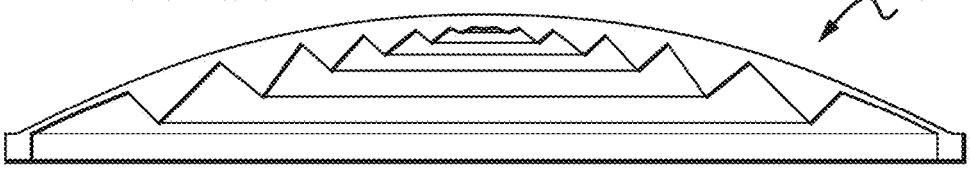

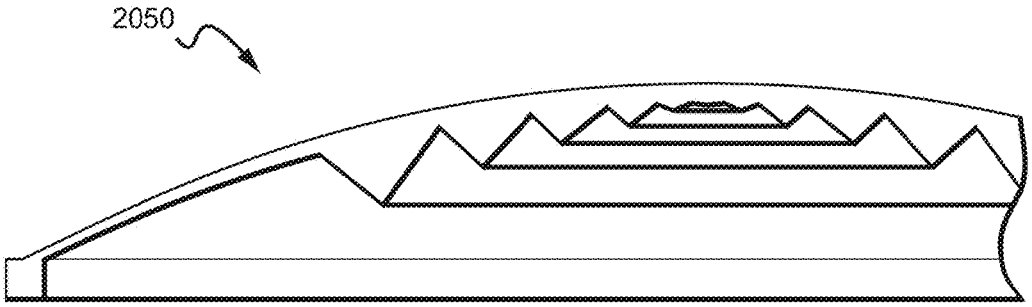
FIG. 39C
FIG. 40A
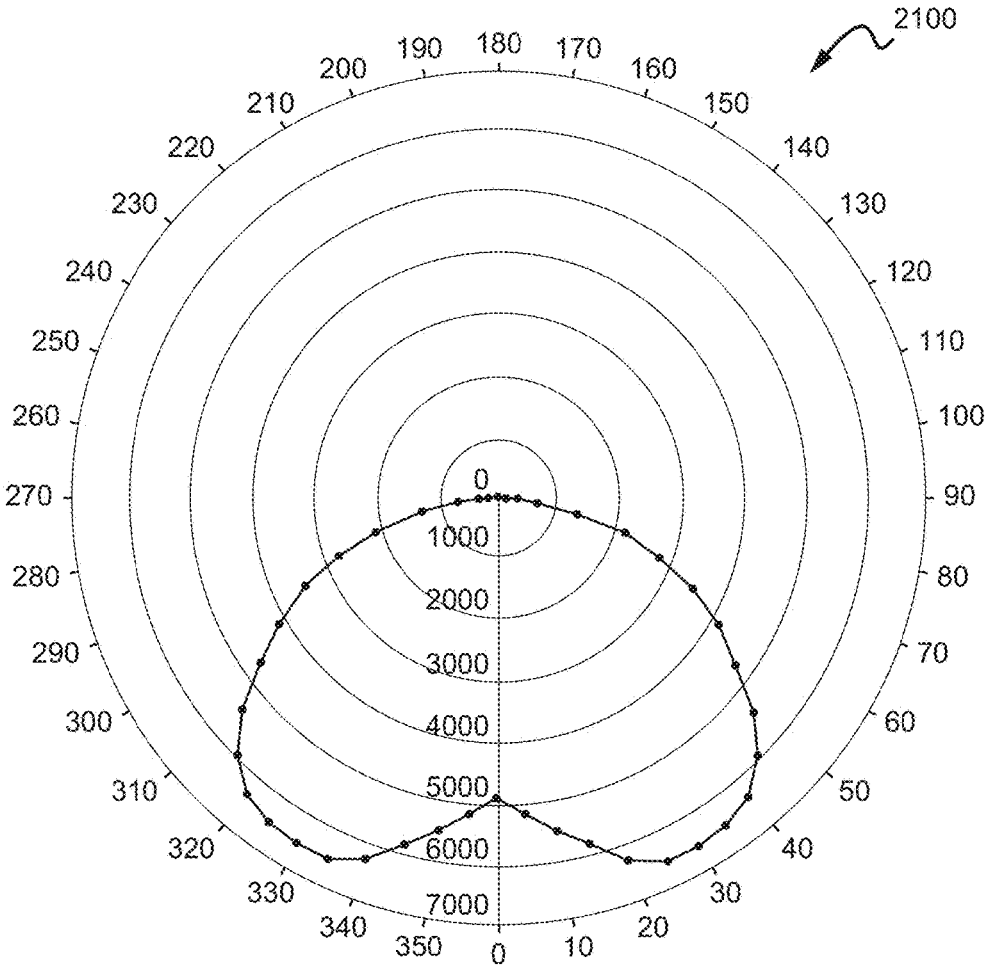

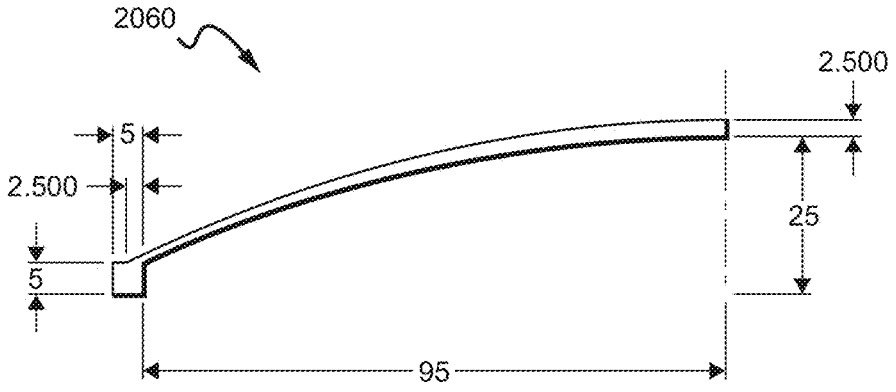
FIG. 39D
FIG. 40B
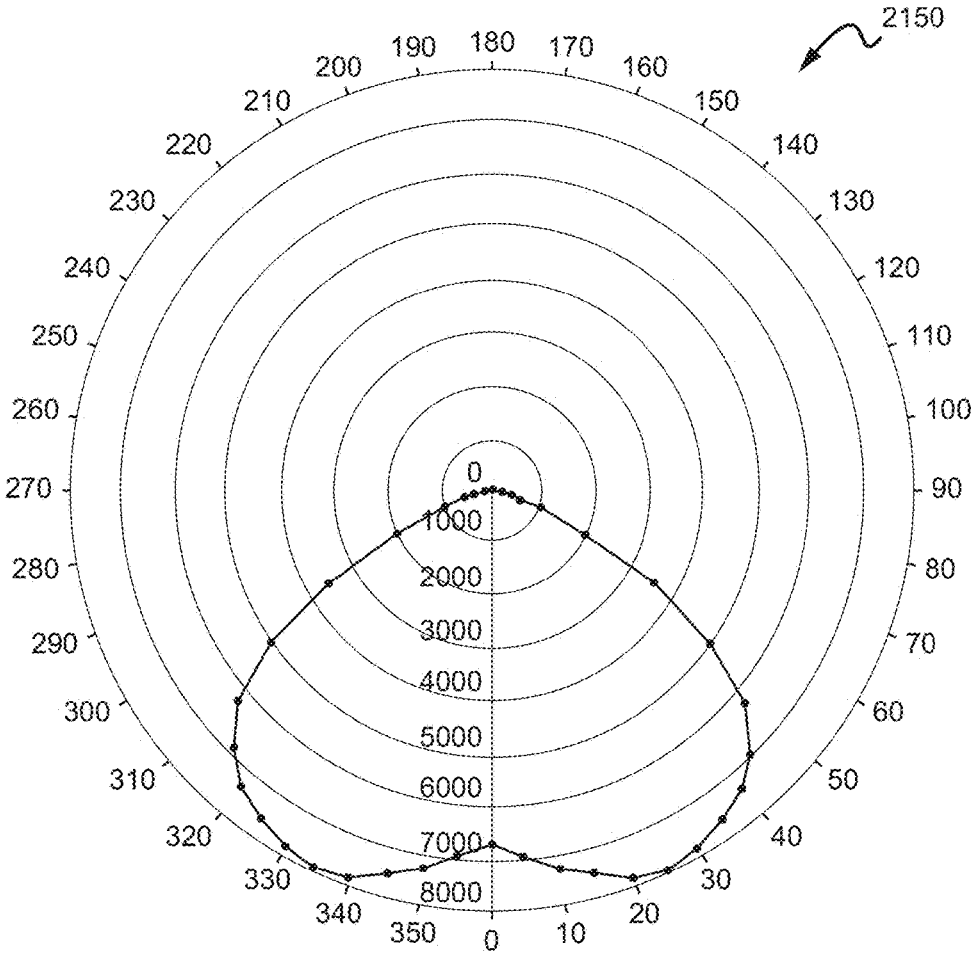

ALUMINUM HIGH BAY LIGHT FIXTURE HAVING PLURALITY OF HOUSINGS DISSIPATING HEAT FROM LIGHT EMITTING ELEMENTS

BACKGROUND OF THE INVENTION

Field of the Invention

The present invention relates to lighting fixtures and in particular an improved design for high bay lighting fixtures which more effectively dissipates heat generated by the light source throughout the fixture, thus eliminating the need for a traditional heat sink.

Description of the Related Art

Industrial or commercial buildings are often illuminated by free-standing lighting fixtures that may be suspended from the ceiling. Certain types of commercial or industrial environments, such as store aisles or warehouses, require lighting that is designed to provide a high degree of luminosity, while still maintaining control over glare. The type of lighting fixture that satisfies these requirements is commonly referred to as bay lighting.

Bay lighting may be classified as high bay or low bay, depending on the height of the lighting fixture, which is usually the distance between the floor of the room seeking to be illuminated and the fixture itself. Naturally, large industrial or commercial buildings with overhead lighting are typically illuminated with high bay lighting fixtures.

In order to sufficiently illuminate this type of environment, a high bay lighting fixture with a high intensity discharge can be used. Yet high intensity lighting fixtures often use light sources such as incandescent, halogen, or fluorescent bulbs, which can have short life spans, difficulty maintaining their intensity, or high maintenance costs. The advent of solid state lighting devices with longer life spans and lower power consumption presented a partial solution to these problems.

One example of a solid state lighting device is a light emitting diode (LED). LEDs convert electric energy to light, and generally comprise one or more active layers of semiconductor material sandwiched between oppositely doped layers. When a bias is applied across the doped layers, holes and electrons are injected into the active layer where they recombine to generate light. Light is emitted from the active layer and from all surfaces of the LED.

In comparison to other light sources, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000 to 20,000 hours, but provide less desirable color reproduction. In comparison, LEDs can have lifetimes between 50,000 and 70,000 hours. The increased efficiency and extended lifetime of LEDs is attractive to many lighting suppliers and has resulted in LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

As mentioned above, high bay lighting fixtures usually require a high intensity light source, based on the illumination requirement of their industrial or commercial environment. Yet a problem with most high intensity lighting devices is that they can draw large currents, which in turn generates significant amounts of heat. High intensity LEDs are no exception. The type of high intensity LEDs used in high bay lighting fixtures likewise produce a large amount of heat. Even if an LED is particularly efficient, the amount of heat that it produces can still be substantial. Without an effective way to dissipate heat that is produced, LED light sources can suffer elevated operating temperatures, which can increase their likelihood of failure. Therefore, in order to operate most effectively and reliably, LED light sources need an efficient method to dissipate heat.

One common method that LED high bay lighting fixtures use for heat dissipation is a heat sink. A heat sink is essentially an element that is in thermal contact with a light source, so that it dissipates heat from the light source. Whenever the heat dissipation ability of the basic lighting device is insufficient to control its temperature, a heat sink is desirable. Some common heat sink materials are aluminum alloys, but other materials or combinations of materials with good thermal conductivity and heat dissipation potential will suffice.

Many common LED high bay lighting fixtures include a heat sink that is in thermal contact with the light source. FIG. 1 displays one such example of a typical LED high bay lighting fixture 10. Included in this example are an LED driver housing 12, a heat sink 14, and a spun housing 16. The heat sink 14 can be a large "extrusion/stack fin" heat sink, which can be made of a heat conductive material such as aluminum. Likewise, the spun housing 16 can also be composed of a metal such as aluminum. The large size of the heat sink 14 is typical in order to dissipate the heat from a high intensity light source commonly used in high bay lighting.

FIG. 2 displays another example of a traditional LED high bay lighting fixture 20. In this example, the high bay lighting fixture 20 includes a high intensity discharge ballast 22 and a spun housing 26. Lighting ballasts can refer to any component that is intended to limit current flow through a light source. The ballast 22 displayed in FIG. 2 is a common choice for many high bay lighting fixtures and other high intensity discharge lighting fixtures. As in the previous example, the spun housing 26 is typically made of aluminum.

Yet another problem in high intensity lighting is that some LEDs are not particularly tolerant of heat sinks or ballasts. This problem can also be apparent in high efficiency LEDs, which have become increasingly popular within the high intensity lighting industry. Once again, high bay lighting fixtures are no exception to this issue.

SUMMARY OF THE INVENTION

Based on the aforementioned issues, there is an increasing demand for options within high bay lighting that can effectively dissipate the heat generated by the light source while also eliminating the need for a traditional heat sink. By removing the heat sink, there can be a reduction in height, weight, and cost of the lighting fixture.

The present invention is generally directed to different embodiments of high bay lighting fixtures comprising many improved features, such as the ability to dissipate heat from a light source in a non-traditional manner. One such example utilized by the different embodiments of the present invention is the elimination of a need for a traditional heat sink. This can be accomplished in several manners, one of which is to actually use one or more housings as a heat sink. In order to do so, the housings can be in thermal contact with the light source to sufficiently assist with heat dissipation. Additionally, a heat spreader plate can be in thermal contact with the light source, so that it can dissipate heat and spread it throughout the lighting fixture.

Different embodiments can also reduce and dissipate the heat from the light source and eliminate the need for a traditional heat sink by spreading out the actual light sources. Another example of different embodiments improving heat dissipation is through the use of air slots in the housings, so that heat can more easily escape. Still another example that different embodiments use to dissipate heat from the light sources is by utilizing heat fins.

One embodiment of a lighting fixture according to the present invention comprises a plurality of light emitting elements, a heat spreader plate in thermal contact with said plurality of light emitting elements, and a housing in thermal contact with said plurality of light emitting elements.

Another embodiment of a lighting fixture according to the present invention comprises a plurality of light emitting elements, a heat spreader plate in thermal contact with said plurality of light emitting elements, a spun housing in thermal contact with said plurality of light emitting elements, and a driver housing on said spun housing, said driver housing in thermal contact with said plurality of light emitting elements.

Still another embodiment of a lighting fixture according to the present invention comprises one or more light emitting elements, a heat spreader plate in thermal contact with said one or more light emitting elements, a primary housing in thermal contact with said one or more light emitting elements, and one or more secondary housings in thermal contact with said one or more light emitting elements.

Another embodiment of a lighting fixture according to the present invention comprises a plurality of light emitting elements, a heat spreader plate in thermal contact with said plurality of light emitting elements, and multiple housings in thermal contact with said plurality of light emitting elements, wherein said multiple housings overlap with one another to create the appearance of a singular housing.

These and other aspects and advantages of the invention will become apparent to those skilled in the art from the following detailed description and the accompanying drawings, which illustrate by way of example the features of the invention.

BRIEF DESCRIPTION OF THE DRAWINGS

FIG. 1 is a perspective view of a traditional LED high bay lighting fixture;

FIG. 2 is a perspective view of another example of a typical high bay lighting fixture;

FIG. 3 is a top perspective view of one embodiment of a lighting fixture according to the present invention;

FIG. 6 is a bottom perspective view of one embodiment of a lighting fixture according to the present invention;

FIG. 7 is a schematic showing the interconnections between one embodiment of a light emitting element according to the present invention;

FIG. 8 is a top view of a Cree® XLamp® CXA2520 LED array;

FIG. 9 is a top close-up view of one embodiment of a lighting fixture according to the present invention;

FIG. 10 is a perspective view of one embodiment of a section of a lighting fixture according to the present invention;

FIG. 10A is a close-up view of one embodiment of a light emitting element connection component according to the present invention;

FIG. 10B is a bottom perspective view of a light emitting elements holder according to the present invention;

FIG. 11 is a view of another embodiment of a section of a lighting fixture according to the present invention;

FIG. 12 is a perspective view of one embodiment of a heat transfer device according to the present invention;

FIG. 13 is a perspective view of another embodiment of a heat transfer device according to the present invention;

FIG. 13A is a sectional view of another embodiment of a heat transfer device according to the present invention;

FIG. 14 is a bottom view of one embodiment of a lighting fixture according to the present invention;

FIG. 15 is a top view of one embodiment of a lighting fixture according to the present invention;

FIG. 16 is a perspective view of one embodiment of a housing component according to the present invention;

FIG. 24 is a perspective view of another embodiment of a lighting fixture according to the present invention;

FIG. 25 is a perspective view of another embodiment of a lighting fixture according to the present invention;

FIG. 26 is a perspective view of another embodiment of a lighting fixture according to the present invention;

FIG. 27 is a bottom perspective view of another embodiment of a lighting fixture according to the present invention;

FIG. 35A is a perspective view of one embodiment of an optical design according to the present invention;

FIG. 35B is a light distribution plot for an optical design according to the present invention;

FIG. 36A is a perspective view of another embodiment of an optical design according to the present invention;

FIG. 36B is a light distribution plot for an optical design according to the present invention;

FIG. 37A is a perspective view of another embodiment of an optical design according to the present invention;

FIG. 37B is a light distribution plot for an optical design according to the present invention;

FIG. 38 is a perspective view of another embodiment of an optical design according to the present invention;

FIG. 39 is a perspective view of another embodiment of an optical design according to the present invention;

FIG. 39A is a sectional view of one embodiment of a lens according to the present invention;

FIG. 39B is a sectional view of one embodiment of a lens according to the present invention;

FIG. 39C is a sectional view of one embodiment of a lens according to the present invention;

FIG. 39D is a dimensional graph of one embodiment of a lens according to the present invention;

FIG. 40A is a light distribution plot for an optical design according to the present invention; and FIG. 40B is a light distribution plot for an optical design according to the present invention.

DETAILED DESCRIPTION OF THE INVENTION

Figure 4:
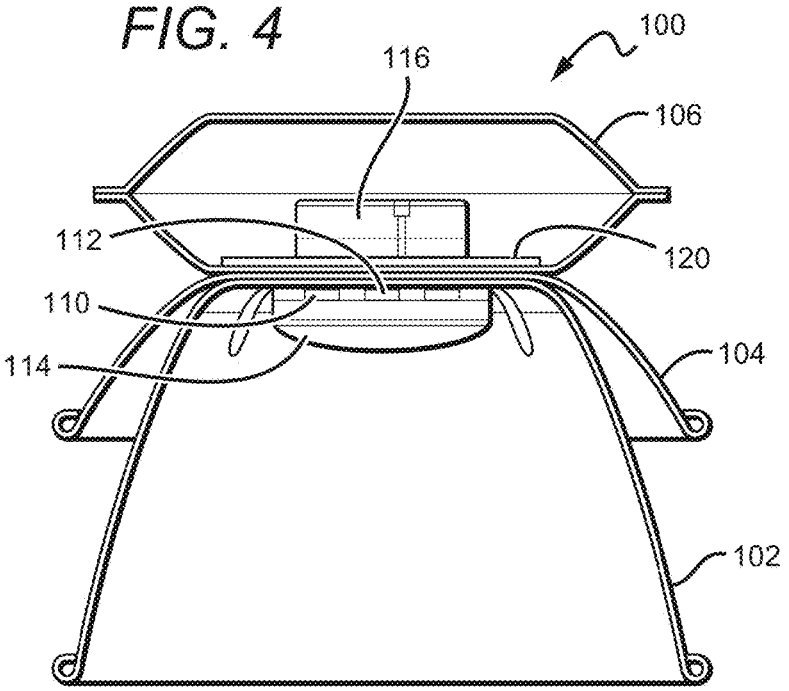
FIG. 4 is a sectional view of one embodiment of a lighting fixture according to the present invention.

The present invention is directed to different embodiments of lighting fixtures comprising many improved features, such as an improved manner of dissipating heat from a light source. Some embodiments of the present invention focus on improving high bay lighting fixtures. Some embodiments of the invention also focus on non-traditional heat dissipation methods, such as sufficiently dispelling heat from a light source without the use of a conventional heat sink. By providing a light source without a conventional heat sink, some embodiments of the invention can reduce the height, weight, and cost of the lighting fixture, in addition to improving the overall profile of the fixture.

In some embodiments, the individual light emitting elements are dispersed apart from one another. By spreading out the light sources, the heat produced by the individual light sources can be more easily dissipated. As discussed previously, a reduction in the thermal effect on the light emitting elements can lead to a corresponding increase in the efficacy and life span of the light sources. Furthermore, spreading out the light sources makes it easier to dispel heat away from the light sources themselves and disperse it throughout the entire light fixture. Also, the more efficiently heat is dispersed throughout a larger surface area, the faster it can be dissipated.

The light sources can be arranged in a variety of ways in different embodiments according to the present invention. Some embodiments can utilize an array of light emitting elements. Multiple arrays of light emitting elements can also be used, or even an array of arrays. As discussed above, it is preferable to use LEDs as the light emitting elements. Therefore, some embodiments use an array of LED chips as the light sources. The array of LED chips can also be mounted on a substrate.

Some embodiments can also connect the light emitting elements in a manner that increases the overall reliability of the light source. One example can be to connect the light emitting elements in a ladder-like formation. This involves taking strings of light emitting elements that are connected in series, and cross-connecting the strings so that they are also connected in parallel. Hence, each individual light emitting element is connected both is series and in parallel, so the resulting formation resembles a ladder. By connecting the light emitting elements in this manner, if an individual light source ceases to operate, then the remaining light sources will continue to function. As such, the loss of a single light emitting element will not result in the failure of an entire string of light emitting elements. However, the light emitting elements of the present invention can be connected in any manner, especially manners that can reduce the likelihood of light emitting element failure.

Because of the nature of high bay lighting, and its application to commercial and industrial purposes, light emitting devices that can effectively handle extended periods of high intensity emission are preferable. As such, it can be preferable to use high efficacy LEDs. Some embodiments may utilize forward voltage operating LEDs. Furthermore, some embodiments can use LEDs that allow for high voltage, low current operation. The lower current operation of these types of LEDs assists with controlling heat production, which is desirable within high bay lighting.

In some embodiments, the lighting fixture of the present invention can include a heat spreader plate. The heat spreader plate can essentially function as a heat sink. As previously described, some embodiments of the present invention eliminate the need for a traditional heat sink, and the heat spreader plate can help to disperse any heat produced by the light sources and spread it to other parts of the lighting fixture, such as the housings. Therefore, in some embodiments the heat spreader plate can be in thermal contact with the light emitting elements. Furthermore, in some embodiments, the light emitting elements can be on the heat spreader plate. In some embodiments, the heat spreader plate can serve as a primary source of heat dissipation for the lighting fixture, while in other embodiments the heat spreader plate can be a secondary source of heat dissipation. Additionally, the heat spreader plate can comprise any material with good thermal conductivity.

In other embodiments, the lighting fixture can include one or more housings, which can have multiple functions. The housings can help reflect or direct the emission of the majority of light in its intended direction. As stated above, in most high bay lighting fixtures, the intended direction of emission for the majority of light will be down towards the floor. Some embodiments provide that the housings can perform the function of a heat sink. As discussed above, some embodiments of the present invention eliminate the need for a traditional heat sink, and the housings can help to dissipate heat that is produced by the light source. Thus, some embodiments provide that the housings can be in thermal contact with the light emitting elements. Other embodiments provide that the housings can be in thermal contact with the heat spreader plate. In some embodiments, the housings can serve as a primary source of heat dissipation for the lighting fixture, while in other embodiments the housings can be a secondary source of heat dissipation. The housings can also have a reflective coating or surface, so as to more easily reflect and/or direct light emitted from the light emitting elements. Additionally, any housing according to the present invention can comprise any material with good thermal conductivity.

In some embodiments, multiple housings are included in the lighting fixture. Some embodiments provide that the multiple housings comprise a primary housing, in addition to one or more secondary housings. In most embodiments including multiple housings, the housings can help to dissipate heat produced by the light sources. As such, some embodiments provide that multiple housings, including the primary housing and/or one or more secondary housings, can be in thermal contact with the light emitting elements. Also, the multiple housings, including the primary housing and/or one or more secondary housings, can comprise any material with good thermal conductivity. In some embodiments, the multiple housings can serve as the primary source of dissipating heat throughout the lighting fixture, while other embodiments provide that they can serve as a secondary source of heat dissipation. In other embodiments, multiple housings can overlap with one another to create the appearance of a singular housing. The addition of multiple housings to the present invention increases the surface area of the lighting fixture. Increasing the surface area enables heat to be more easily transferred away from the light sources and dissipated throughout the housings and entire lighting fixture. Therefore, some embodiments of the present invention have multiple housings to more easily dissipate heat throughout the lighting fixture.

In still other embodiments, the lighting fixture includes a driver box or driver housing. In some embodiments, the driver box or driver housing can comprise any material with good thermal conductivity and facilitate the dissipation of heat from the light emitting elements which spreads to the driver housing. Therefore, in some embodiments the driver box or driver housing can be in thermal contact with the light emitting elements. In other embodiments, the driver box or driver housing can be in thermal contact with the primary housing and/or secondary housings. In still other embodiments, the driver box or driver housing can be on the primary housing. Furthermore, the driver housing can contain a light emitting elements driver. Thus, in some embodiments the driver housing can also be in thermal contact with, and dissipate heat from, a light emitting elements driver.

Still other embodiments provide that the lighting fixture can include heat fins. In the present invention, heat fins can function as a heat sink and facilitate the dissipation of heat produced by the light sources. As such, in some embodiments the heat fins are in thermal contact with the light emitting elements. In other embodiments, the heat fins can be in thermal contact with any of the aforementioned housings of the lighting fixture. Yet in other embodiments the heat fins can be on the housings. Also, the heat fins can comprise any material with good thermal conductivity.

In still other embodiments, slots or openings are included in the lighting fixture. One purpose of these slots or openings is to allow air to flow throughout the lighting fixture, which in turn facilitates the dissipation of heat. Some embodiments have slots or openings in the housings. These slots or openings can be in the primary housing, one or more secondary housings, the driver housing, or any other housing described herein. Another purpose of these slots or openings is to allow some light to emit in the direction opposite that of the majority of light emitted from the light emitting elements. In most instances, the slots or openings can allow light to emit upwards, so that the ceiling can also receive some illumination. Some embodiments can even have slots or openings in the heat spreader plate.

Embodiments of the invention are described herein with reference to different views and illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing.

Throughout this description, the preferred embodiment and examples illustrated should be considered as exemplars, rather than as limitations on the present invention. As used herein, the term "invention," "device," "method," or "present invention" refers to any one of the embodiments of the invention described herein, and any equivalents. Furthermore, reference to various feature(s) of the "invention," "device," "method," or "present invention" throughout this document does not mean that all claimed embodiments or methods must include the referenced feature(s).

It is also understood that when an element or feature is referred to as being "on" or "adjacent" to another element or feature, it can be directly on or adjacent the other element or feature or intervening elements or features may also be present. In contrast, when an element is referred to as being "directly on" or extending "directly onto" another element, there are no intervening elements present. Additionally, it is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "outer," "above," "lower," "below," "horizontal," "vertical" and similar terms may be used herein to describe a relationship of one feature to another. It is understood that these terms are intended to encompass different orientations in addition to the orientation depicted in the figures.

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present invention. As used herein, the term "and/or" includes any and all combinations of one or more of the associated list items.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

FIG. 3 is a perspective view of one embodiment of a lighting fixture 100 according to the present invention. Lighting fixture 100 comprises a primary housing 102, one or more secondary housings 104 (one shown), a driver housing 106, and slots or openings 108. Because FIG. 3 is merely one view of a single embodiment, it is understood that the embodiment can also contain several aspects and elements of the present invention that are not depicted. Other embodiments will depict examples of these elements, which can include, but are not limited to, a plurality of light emitting elements, additional housings, a light emitting elements holder, a lens cover, and a heat spreader plate.

More specifically, FIG. 3 depicts one embodiment of a high bay lighting fixture according to the present invention. FIG. 3 comprises many features that are an improvement on high bay lighting fixtures in general, such as the ability to dissipate heat from a light source in a non-traditional manner. One such example is eliminating the need for a traditional heat sink. By removing a traditional heat sink from the lighting fixture 100, there can be an overall reduction in height, weight, and cost, in addition to improving the overall profile of the fixture. The present invention accomplishes this feat in several manners, one of which can be to use a single housing or multiple housings as a heat sink and assist with heat dissipation. FIG. 3 displays that these housings can comprise a primary housing 102 and one or more secondary housings 104.

In order to dissipate heat from the light emitting elements, the primary housing 102 and/or one or more secondary housings 104 can be in thermal contact with the light emitting elements. Based on this, it can be preferable for the primary housing 102 and/or one or more secondary housings 104 to comprise a material with good thermal conductivity. As used in the present invention, the thermal conductivity of a material refers to that particular material's ability to conduct heat. Therefore, if the thermal conductivity of a material is high, then there is a low thermal resistivity and heat can transfer across the material at a high rate.

The thermal conductivity of a particular element of the lighting fixture 100 is dependent upon both the type of material and the surface area. Because the material of an object is constant, the surface area must increase in order to increase the thermal conductivity of an object. Therefore, to improve the heat dissipating ability of the lighting fixture 100, it can be preferable to increase the overall surface area. This is one of the reasons that some embodiments of the present invention can have multiple housings, such as the primary housing 102 and one or more secondary housings 104.

Of course, if the lighting fixture 100 is composed of materials with a high thermal conductivity, this can also help to dissipate heat more effectively. Some good examples of thermally conductive materials are aluminum, steel, zinc, copper, tin, ceramic, or thermally conductive plastic. Because it is advantageous for the lighting fixture 100 to be thermally conductive, any aspect of the lighting fixture can comprise any of the above-mentioned materials. Some examples of lighting fixture components that can comprise materials with good thermal conductivity are the heat spreader plate, the primary housing, the one or more secondary housings, the driver housing, and/or any component that dissipates heat. It is understood that the present invention is not limited to having good thermal conductivity in the components above, as any component of the lighting fixture can have good thermal conductivity.

According to one embodiment of the present invention shown in FIG. 3, the primary housing 102 can have multiple functions. The primary housing 102 can help to reflect and/or direct the emission of the majority of light in its intended direction. As stated above, in most high bay lighting fixtures, the intended direction of emission for the majority of light will be down towards the floor.

In some embodiments of the present invention, the primary housing 102 can function as a primary source of dissipating heat throughout the lighting fixture 100, while in other embodiments the primary housing 102 can serve as a secondary source of heat dissipation. Furthermore, the primary housing 102 can comprise one or more thermally conductive materials to dissipate heat more effectively. The primary housing 102 may also be referred to as a spun housing, because it can comprise spun materials, such as spun aluminum. However, the primary housing 102 can comprise many differently shaped structures and be manufactured in a number of different ways. The primary housing 102 can also include a reflective coating or surface, so that it can more easily reflect and/or direct the light emitted from the light emitting elements.

The one or more secondary housings 104 can serve as supplementary housings to the primary housing 102, and assist the primary housing 102 in accomplishing its intended functions, such as dissipating heat. In some embodiments, the one or more secondary housings 104 can even help to reflect and/or direct any light not reflected and/or directed by the primary housing 102. In some embodiments, this can occur because light is emitted through slots or openings in the primary housing. The one or more secondary housings 104 can also expand the surface area of the lighting fixture 100, so as to assist with the process of heat dissipation. In some embodiments of the present invention, the one or more secondary housings 104 can serve as a primary source of dissipating heat from the light emitting elements and spreading it throughout the lighting fixture 100, while in other embodiments the one or more secondary housings 104 can serve as a secondary source of heat dissipation. To help facilitate the dissipation of heat throughout the lighting fixture 100, the one or more secondary housings 104 can be in thermal contact with the light emitting elements. Thus, the one or more secondary housings 104 can comprise one or more thermally conductive materials. The one or more secondary housings 104 can also comprise spun materials, such as spun aluminum, but the one or more secondary housings 104 can comprise many differently shaped structures and be manufactured in a number of different ways. The one or more secondary housings 104 can also include a reflective coating or surface.

The lighting fixture 100 of FIG. 3 can also include a driver housing 106. Similar to the other housings in the present invention, the driver housing 106 can serve as a source of dissipating heat produced by the light sources. Therefore, in some embodiments the driver housing 106 is in thermal contact with the light emitting elements. In other embodiments, the driver housing 106 can be in thermal contact with the primary housing 102 and/or one or more secondary housings 104, in order to allow heat to dissipate throughout the lighting fixture 100. In still other embodiments, the driver housing 106 can be on the primary housing 102 and/or one or more secondary housings 104. To help facilitate the dissipation of heat throughout the lighting fixture 100, the driver housing 106 can also comprise one or more thermally conductive materials. Just like the other housings, the driver housing 106 can also comprise spun materials, such as spun aluminum, but the driver housing 106 can comprise many differently shaped structures and be manufactured in a number of different ways. The driver housing 106 can also be referred to as a driver box, which should not alter its purpose or function according to the present invention.

The lighting fixture 100 of FIG. 3 can also include slots or openings 108. One purpose of the slots or openings 108 is to allow air to flow throughout the lighting fixture 100, which facilitates the dissipation of heat. The slots or openings 108 can be present in any of the housings according to the lighting fixture 100, including the primary housing 102 and one or more secondary housings 104. The slots or holes 108 can even be present in the driver housing 106. Some embodiments according to the present invention can also include the slots or openings 108 in a heat spreader plate. In fact, the slots or openings 108 can be present in any aspect of the lighting fixture 100 where air flow can help to improve heat dissipation.

Another function of the slots or openings 108 is to allow some light to emit in the direction opposite that of the majority of light. In most instances, the slots or openings 108 will allow some light from the light source to emit upwards, so that the ceiling can also receive some illumination, while the majority of light is emitted in a downward direction towards the floor. The amount of light emitted through the slots or openings 108 is usually much less in comparison to the majority of light. The percentage of total light emitted through the slots or openings 108 can be around 5-15%, but can be more or less depending upon the specific need of the present invention.

FIG. 4 is a sectional view of the lighting fixture 100 according to the present invention. As depicted in FIG. 4, the lighting fixture 100 comprises a primary housing 102, one or more secondary housings 104 (one shown), a driver housing 106, slots or openings 108, a plurality of light emitting elements 110, a heat spreader plate 120, a light emitting elements holder 112, a lens cover 114, and a light emitting elements driver 116.

The plurality of light emitting elements 110 can be the primary light source in the lighting fixture 100. According to FIG. 4, the light emitting elements 110 can be located near the center of the lighting fixture 100, near the junction of the primary housing 102 and the driver housing 106. Like most high bay lighting fixtures, it can be preferable for the light emitting elements 110 to comprise a high intensity light source. As discussed above, it is also desirable for the light emitting elements 110 to have a long lifespan. Therefore, some embodiments of the present invention provide that the light emitting elements 110 can comprise LEDs. In some embodiments, the light emitting elements 110 may comprise LEDs that allow for high voltage, low current operation. In these embodiments, the light emitting elements 110 are operating at a lower current, which can assist with controlling heat production. Additionally, the light emitting elements 110 can be in a ladder-like chip formation, which will be discussed more extensively later in this disclosure.

In some embodiments according to the present invention, the individual light emitting elements 110 can be spread apart from one another. By spreading out the light emitting elements 110, any heat produced by the light emitting elements 110 can be more easily dissipated away from the light emitting elements 110 and dispersed throughout the lighting fixture 100. Furthermore, in order to sufficiently dissipate heat, the light emitting elements 110 can be in thermal contact with the primary housing 102, the one or more secondary housings 104, the driver housing 106, the heat spreader plate 120, and/or the light emitting elements holder 112. In addition, to keep the light emitting elements 110 in the proper position, the light emitting elements 110 can be held by the light emitting elements holder 112, or clamped, glued down, or secured in some other manner.

Additionally, the light emitting elements 110 can be arranged in a variety of ways in different embodiments according to the present invention. Some embodiments can arrange the light emitting elements 110 in an array. The light emitting elements 110 can also be in a formation of multiple arrays together or even an array of arrays. As discussed above, the light emitting elements 110 can comprise LEDs or LED chips. In other embodiments, the light emitting elements 110 can be on a substrate. Therefore, some embodiments of the present invention can include an array of LED chips mounted on a substrate.

As displayed in FIG. 4, in some embodiments of the present invention, the lighting fixture 100 can also include a heat spreader plate 120. In some embodiments, the heat spreader plate 120 can be in thermal contact with the light emitting elements 110, so as to help spread out and dissipate heat from the light emitting elements 110 throughout the lighting fixture 100. In still other embodiments, the light emitting elements 110 can be on the heat spreader plate 120. As depicted in FIG. 4, the heat spreader plate 120 can be placed near the junction of the driver housing 106 and the primary housing 102. Also, the heat spreader plate 120 can be inside the bottom of the driver housing 106 or inside the top of the primary housing 102. The heat spreader plate 120 can also be in thermal contact with the primary housing 102, the one or more secondary housings 104, the driver housing 106, and/or the light emitting elements holder 112. Because of its heat dissipation capabilities, the heat spreader plate 120 can function as a heat sink for the lighting fixture 100. Also, the heat spreader plate 120 can be a primary or a secondary source of heat dissipation for the lighting fixture 100. In some embodiments, the heat spreader plate 120 can include a reflective coating or surface. Additionally, in other embodiments, the light emitting elements holder 112 can be on the heat spreader plate 120.

Also shown in FIG. 4, some embodiments of the lighting fixture 100 can also include a light emitting elements holder 112. As depicted in FIG. 4, the holder 112 can be in thermal contact with the light emitting elements 110 and/or on the light emitting elements 110. Therefore, holder 112 can be positioned next to the light emitting elements 110, such as near the bottom of the driver housing 106 or near the top of the primary housing 102. However, it is understood that the holder 112 may be placed in other positions around the lighting fixture 100. One of the functions of the holder 112 can be to hold and maintain the position of the light emitting elements 110. The holder 112 can simplify the installation process of the light emitting elements 110 within the lighting fixture 100. For example, the holder 112 can eliminate the need to solder the light emitting elements 110 in place. Because the light emitting elements 110 can comprise LEDs, the holder 112 can also be referred to as an LED holder. Furthermore, the holder 112 can be in thermal contact with the light emitting elements 110, so that it can help with the process of heat dissipation.

The lighting fixture 100 can also include a lens cover 114. The lens cover 114 can be positioned over and/or around the light emitting elements 110. Because the lens cover 114 can be arranged to cover the light emitting elements 110, one of its functions can be to protect the light emitting elements 110. In other embodiments of the present invention, the lens cover 114 can filter, mix, and/or disperse the light emitted from the light emitting elements 110. The lens cover 114 can also be in thermal contact with the light emitting elements 110.

FIG. 4 shows one embodiment of the lighting fixture 100, but there can be other arrangements of components within the lighting fixture. The driver housing 106 can be on, stacked on, and/or directly on the primary housing 102 and/or one or more secondary housings 104. Furthermore, the one or more secondary housings 104 can be on, stacked on, and/or directly on the primary housing 102. The one or more secondary housings 104 can also be overlapping the primary housing 102, or the primary housing 102 can be inside and/or nested in the one or more secondary housings 104. In some embodiments, the primary housing 102 and one or more secondary housings 104 can be congruent.

The light emitting elements driver 116 can be inside, nested in, on, stacked on, and/or directly on the primary housing 102, the one or more secondary housings 104 and/or the driver housing 106. The heat spreader plate 120 can also be inside, nested in, on, stacked on, and/or directly on the primary housing 102, the one or more secondary housings 104, and/or the driver housing 106. Additionally, the light emitting elements holder 112 can be inside, nested in, on, stacked on, and/or directly on the primary housing 102, the one or more secondary housings 104 and/or the driver housing 106. Furthermore, the light emitting elements 110 can be inside, nested in, on, stacked on, and/or directly on the primary housing 102, the one or more secondary housings 104 and/or the driver housing 106. Also, the lens cover 114 can be inside, nested in, on, stacked on, and/or directly on the primary housing 102, the one or more secondary housings 104 and/or the driver housing 106.

The light emitting elements driver 116 can be on, stacked on, and/or directly on the heat spreader plate 120, the light emitting elements 110, the light emitting elements holder 112, and/or the lens cover 114. In addition, the heat spreader plate 120 can be on, stacked on, and/or directly on the light emitting elements 110, the light emitting elements holder 112, light emitting elements driver 116, and/or the lens cover 114. The light emitting elements 110 can be on, stacked on, and/or directly on the light emitting elements holder 112, the light emitting elements driver 116, the heat spreader plate 120, and/or the lens cover 114. Moreover, the light emitting elements holder 112 can be on, stacked on, and/or directly on the heat spreader plate 120, the light emitting elements 110, the light emitting elements driver 116, and/or the lens cover 114. Also, the lens cover 114 can be on, stacked on, and/or directly on the heat spreader plate 120, the light emitting elements 110, the light emitting elements driver 116, and/or the light emitting elements holder 112.

In addition, any component in the lighting fixture 100 can be a heat dissipating element. For example, the primary housing 102, the one or more secondary housings 104, the driver housing 106, the slots or openings 108, the heat spreader plate 120, the light emitting elements holder 112, the lens cover 114, and/or the light emitting elements driver 116 can dissipate heat within the lighting fixture 100. All of the above components, or any other component in the lighting fixture 100, can be referred to as a heat dissipating element, or any other term that describes heat dissipating capabilities. The heat spreader plate 120 can also be referred to as a heat transfer device, a heat transfer element, a heat spreading device, a heat spreading element, a heat spreader column and/or any other term that describes its heat transferring and dissipating capabilities. Additionally, any component in the lighting fixture 100 can have slots or openings to improve their heat dissipating capabilities.

Figure 5:
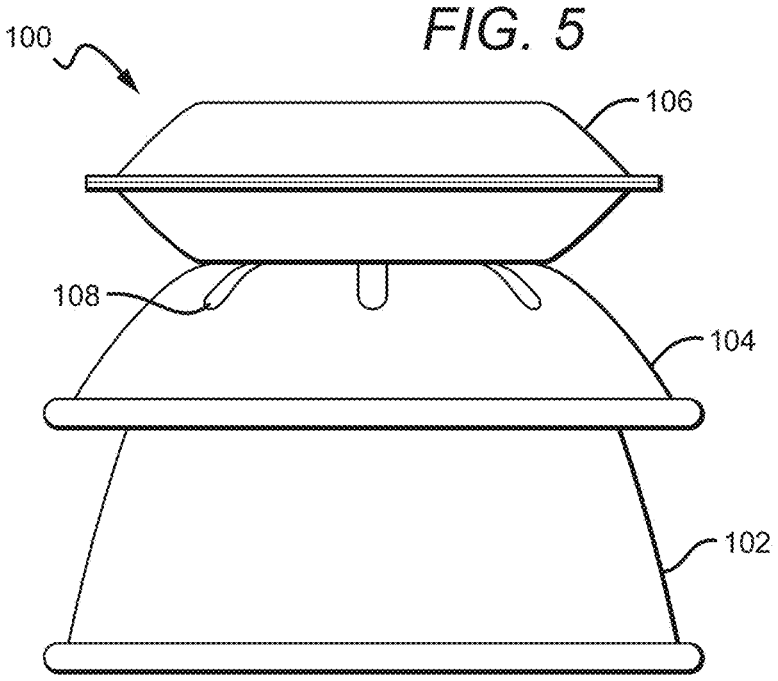
FIG. 5 is a side view of one embodiment of a lighting fixture according to the present invention.

FIGS. 5 and 6 are views from different angles of the lighting fixture 100. FIG. 5 is a side view of the lighting fixture 100, while FIG. 6 is a bottom perspective view of the lighting fixture 100. The lighting fixture 100 of both FIGS. 5 and 6 can include all the components of FIGS. 3 and 4, including a primary housing 102, one or more secondary housings 104, a driver housing 106, and slots or openings 108. FIG. 5 only exhibits slots or openings 508 in the one or more secondary housings 104, but that is because the one or more secondary housings 104 are covering the top of the primary housing 102. FIG. 6 displays the inside of the primary housing 102, so it reveals that slots or holes 108 can be in the primary housing 102. The lighting fixture 100 can include slots or openings 108 in any of components shown in FIGS. 5 and 6, including the primary housing 102, one or more secondary housings 104, and/or the driver housing 106.

FIG. 7 is a schematic showing the interconnections between one embodiment of a light emitting element 200 according to the present invention. The light emitting sub-elements 210 can be connected between input contact point 220 and output contact point 230 in a manner that increases the overall efficiency of the light emitting element 200. FIG. 7 displays that the light emitting sub-elements 210 can be connected in a ladder-like formation. This type of connection involves taking strings of light emitting sub-elements 210 that are connected in series, and cross-connecting the strings so that they are also connected in parallel. Therefore, each of the individual light emitting sub-elements 210 is connected both in series and in parallel. The resulting cross-connection formation resembles a ladder, hence the reference to a ladder-like formation. By connecting the light emitting sub-elements 210 in this manner, if any individual light emitting sub-elements 210 fail, then the remaining light emitting sub-elements 210 can still function. As such, the present invention can provide for a fault tolerant interconnection, where the loss of any single light emitting sub-elements 210 will not coincide with the failure of an entire string of light emitting sub-elements 210.

FIG. 7 also exhibits that the light emitting element 200 can comprise LEDs or LED chips. Furthermore, the light emitting sub-elements 210 can comprise sub-LEDs. Additionally, the connections displayed in FIG. 7 are only a few of the many different series and/or parallel connection arrangements of the light emitting elements that can exist in the present invention. It is understood that the light emitting elements of the present invention can be connected in any manner, including any manner which comprises fault tolerant interconnections.

As previously mentioned, some embodiments provide that the light source can comprise an array of light emitting elements or an array of LEDs. Other embodiments of the present invention can include an array of LED chips mounted on a substrate. FIG. 8 is a top view of one example of a light emitting element 300 that can be used in the present invention. Specifically, FIG. 8 exhibits a Cree® XLamp® CXA2520 LED array. The Cree® XLamp® CXA2520 is one example of an LED array that can be used as a light source in the present invention. The XLamp® CXA2520 can deliver high lumen output and high efficacy in a single LED array package. (See Cree® XLamp® CXA2520 LED data sheet; available at http://www.cree.com/led-components-and-modules/products/xlamp/arrays-nondirectional/~/media/Files/Cree/LED%20Components%20and%20Modules/XLamp/Data%20and%20Binning/XLampCXA2520.pdf).

Other types of LEDs can be used for the light emitting elements in the present invention. One example of LEDs that can be used in the present invention are the entire Cree® XLamp® family, including: CXA1507, CXA1512, CXA2011, CXA2530, MC-E, MK-R, ML-B, ML-C, ML-E, MP-L, MT-G, MT-G2, MX-3, MX-6, XB-D, XM-L, XM-L2, XP-C, XP-E, XP-E2, XP-G, XP-G2, XR-C, XR-E, and XT-E. Any other type of high intensity emission LED is also suitable for use in the present invention. (See e.g., Cree® LED components and modules products webpage, available at http://www.cree.com/led-components-and-modules/products). It is understood that other types of LEDs and light emitting devices not mentioned herein can also be used in this and other embodiments of the present invention.

FIG. 9 is a top close-up view of one embodiment of a lighting fixture 400 according to the present invention. The lighting fixture 400 can comprise light emitting elements 410, a light emitting elements holder 412, and a housing 402. The light emitting elements 410 in FIG. 9 are Cree® XLamp® CXA2520 LED arrays, but it is understood that the light emitting elements 410 can comprise other types of LEDs. Not shown in FIG. 9 is a heat spreader plate, which is under the light emitting elements holder 412. As previously mentioned, the heat spreader plate can be in thermal contact with the light emitting elements 410, so as to dissipate heat from the light emitting elements 410. Additionally, the light emitting elements holder 412 can be in thermal contact with the light emitting elements 410 and/or the heat spreader plate.

FIG. 9 also exhibits that the individual light emitting elements 410 can be spread apart from one another. By spreading apart the individual light emitting elements 410 from one another, the aggregate heat production of the light emitting elements 410 can be more easily dissipated. This can make it more manageable to dispel heat away from the light emitting elements 410 and disperse it throughout the entire lighting fixture. In turn, the overall heat level around the light emitting elements 410 can be abated. Furthermore, spreading out the individual light emitting elements 410 can also lead to a corresponding increase in the rate of heat dissipation. As previously discussed, a reduction in the thermal effect on the light emitting elements 410 can lead to a corresponding increase in the efficiency and life span of the light emitting elements 410.

FIG. 10 is a perspective view of one embodiment of components that can be used in lighting fixtures according to the present invention. The lighting fixture 500 comprises light emitting elements 510, a light emitting elements holder 512, a light emitting elements driver 516, a heat spreader plate 520, a connection busway 530, and connection pins 532. The light emitting elements 510 can comprise any of the previously mentioned LEDs or LED arrays, such as the Cree® XLamp® CXA2520 LED array, but the light emitting elements 510 can also comprise any other suitable LED or light emitting device. The light emitting elements holder 512 can be in thermal contact with the light emitting elements 510. Moreover, the light emitting elements holder 512 can be on the light emitting elements 510 and/or heat spreader plate 520. The light emitting elements holder 512 can expose any light emitting sections of the light emitting elements 510, and can cover any non-light emitting sections of the light emitting elements 510. In addition, the light emitting elements holder 512 can cover the heat spreader plate 520. Furthermore, the light emitting elements holder 512 can prevent direct contact with the connection busway 530. As displayed by FIG. 10, in some cases, LED array components can have top-based connections. Based on the configuration of the connections, these types of LED array component connections are commonly referred to as busways. The light emitting elements holder 512 can also be referred to as an LED holder.

FIG. 10 also displays that the heat spreader plate 520 can be in thermal contact with the light emitting elements 510, so as to help with the heat dissipation process. The light emitting elements driver 516 can also be in thermal contact with the light emitting elements 510 and/or the heat spreader plate 520. The connection pins 532 can connect the light emitting elements 510 to the connection busway 530. The connection busway 530 can act as a connection between the light emitting elements 510 and the light emitting elements driver 516. The connection busway 530 can also be a guide for the placement of the light emitting elements 510. Furthermore, connection busway 530 can have a single piece design, such as a printed circuit board (PCB). One example of a single piece design is the FR-4 PCB. Additionally, the connection busway 530 can have positive connections and negative connections. Each individual light emitting element 510 can be connected to the positive and negative connections of the connection busway 530.

FIG. 10A is a close-up view of a section of the lighting fixture 500 according to the present invention. Specifically, FIG. 10A depicts a more detailed view of the connection system displayed in FIG. 10. Similar to FIG. 10, the lighting fixture 500 in FIG. 10A can comprise light emitting elements 510, a heat spreader plate 520, a connection busway 530, and connection pins 532. The connection pins 532 connect each individual light emitting element 510 to the positive and negative connections of the connection busway 530. The positive connections of the connection busway 530 can be red in color, while the negative connections of the connection busway 530 can be colored black.

FIG. 10B is a bottom perspective view of the light emitting elements holder 512 according to the present invention. As previously discussed, the light emitting elements holder 512 can expose any light emitting sections of the light emitting elements through the circular openings. Also, the light emitting elements holder 512 can cover any non-light emitting sections of the light emitting elements, such as with the square indentations displayed in FIG. 10B. The light emitting elements holder 512 can comprise any material that is reflective and/or can protect the connection busway. For example, the light emitting elements holder 512 can be made of a highly reflective thermoplastic polymer, such as a polycarbonate. However, it is understood that the light emitting elements holder 512 can comprise any suitable material not mentioned herein. The light emitting elements holder 512 can also comprise a color that enhances reflectivity, such as white.

FIG. 11 is a view of another embodiment of a section of a lighting fixture 550 according to the present invention. The lighting fixture 550 in FIG. 11 can also comprise light emitting elements 560, a heat spreader plate 570, a connection busway 580, and connection pins 582. FIG. 11 displays one embodiment of a connection system according to the present invention, absent a light emitting elements holder.

FIG. 12 is a perspective view of one embodiment of a heat transfer device 600 according to the present invention. As depicted in FIG. 12, the heat transfer device 600 can comprise a heat spreader plate 602. The heat spreader plate 602 can comprise metal, or any material that has good thermal conductivity or heat dissipation qualities. Also, the heat spreader plate 602 can be in thermal contact with the light emitting elements. The heat spreader plate 602 can be a conductive path that transmits at least some heat produced by the light emitting elements, and then dissipates this heat to other components of the lighting fixture. As such, the heat spreader plate 602 can be a device that transfers heat away from the light emitting elements. FIG. 12 displays that if light emitting elements are connected on a plate with good thermal conductivity, the heat transfers though the plate in an outward direction. The heat transfer cross-sectional area for a plate is described by the formula $a=\pi Dt$, where D is the diameter of the heat sources and t is the thickness of the plate. Thus, the heat transfer cross-sectional area will increase as the heat sources are spread out and the diameter increases. FIG. 12 depicts one manner in which the heat spreader plate of the present invention can dissipate heat away from the light emitting elements and spread it throughout the lighting fixture.

FIG. 13 is a perspective view of another embodiment of a heat transfer device 610 according to the present invention. As depicted in FIG. 13, the heat transfer device 610 can comprise a heat spreader column 612. Just like the heat spreader plate above, the heat spreader column 612 can comprise metal, or any material that has good thermal conductivity or heat dissipation qualities. In addition, the heat spreader column 612 can be in thermal contact with the light emitting elements. The heat spreader column 612 can be a conductive path that transmits at least some heat produced by the light emitting elements, and then dissipates this heat to other components of the lighting fixture. As such, the heat spreader column 612 can be a device that transfers heat away from the light emitting elements. FIG. 13 shows that if light emitting elements are connected on a column with good thermal conductivity, the heat transfers though the column. The heat transfer cross-sectional area for a column is described by the formula $a=\pi r^2$, where r is the radius of the heat sources. Thus, the heat transfer cross-sectional area will increase as the heat sources are spread out and the radius increases. It is understood that the present invention is not limited by the heat spreading devices above, and the present invention can comprise any type and/or shape of heat spreading device.

FIG. 13A is a sectional view of another embodiment of a heat transfer device 650 according to the present invention. As displayed in FIG. 13A, the heat transfer device 650 can comprise a liquid 660 and a conductive material 670. The liquid 660 can help with heat transfer because of an evaporation and condensation process. In some embodiments, the operation temperature of the heat transfer device 650 cannot be higher than the melting temperature of the liquid 660. The conductive material 670 can comprise any conductive material, such as any metal or metallic material. Also, in some embodiments, the liquid 660 can be inside the conductive material 670. However, as described above, the heat transfer device 650 can also comprise a solid conductive material, without any liquid. The heat transfer device 650 in FIG. 13A is a column, but it can comprise any other shape, such as a disc or plate.

FIG. 14 is a bottom view of one embodiment of a lighting fixture 700 according to the present invention. Specifically, FIG. 14 shows a direct underside view of a lighting fixture 700. The lighting fixture 700 can include a primary housing 702, slots or openings 708, and a lens cover 714. The slots or openings 708 exhibited in the lighting fixture 700 are present in the primary housing 702; however, the slots or openings 708 can also be in any other housing not displayed in FIG. 14, such as a secondary housing or a driver housing. As previously discussed, the lens cover 714 can cover any light emitting elements according to the present invention.

FIG. 15 is a top view of the lighting fixture 700 according to the present invention. FIG. 15 more specifically exhibits a topside view from directly above the lighting fixture 700. As displayed by FIG. 15, the lighting fixture 700 can include elements such as a primary housing 702, one or more secondary housings 704, a driver housing 706, and slots or openings 708. Because FIG. 15 is a direct topside view, small sections of the primary housing 702 and one or more secondary housings 704 may be visible.

FIG. 16 is a perspective view of one embodiment of a housing component 750 according to the present invention. The housing component 750 can include a housing 752 and slots or openings 758. This embodiment displays one example of how slots or openings 758 can be distributed throughout the housing 752. One way that the slots or openings 758 can be arranged is to maximize air flow through the housing 752. In turn, this maximization of air flow will help heat to dissipate away from any light sources and spread throughout the entire lighting fixture. The housing 752 can be a primary housing or a secondary housing, or any other housing referred to in the present invention. The housing 752 can also include a reflective coating or surface, so that it more easily reflects and directs the light emitted from the light emitting elements. The housing 752 can also be coated with matt white paint, which can improve the thermal radiation of the housing 752. The matt white paint can also help to increase the surface emissivity of the housing 752. For example, matt white paint can increase the surface emissivity of the housing 752 from 0.05 to greater than 0.8. However, the surface emissivity of any housings according to the present invention can be any value, whether less than 0.05, greater than 0.8, or any value there between. Furthermore, the surface area of the housing 752 in FIG. 16 can be around 0.56 $m^2$, but it is understood that the housing 702 can have a larger or smaller surface area as needed.

Figure 17A:
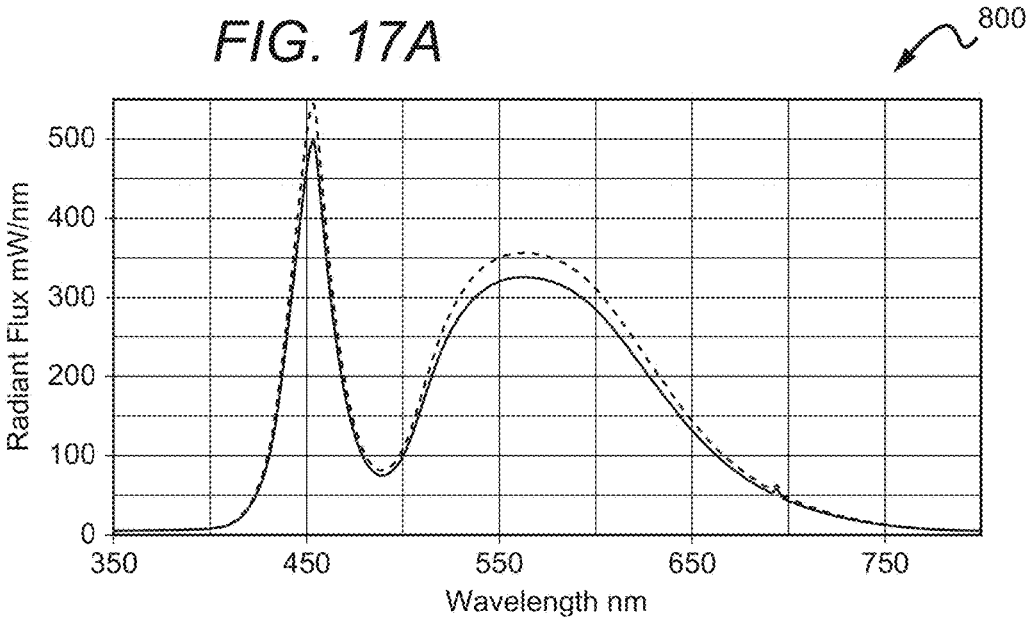
FIG. 17A is a graph charting the relationship between wavelength and radiation flux of light emitting elements according to the present invention.

FIG. 17A is a graph 800 that displays the relationship between wavelength and radiation flux of light emitting elements according to the present invention. Specifically, the graph 800 charts the change in wavelength (nm) of light emitting elements versus the change in radiation flux (mW/nm). The light emitting elements used in testing were twelve Cree® XLamp® CXA2520 LED arrays, which were discussed previously; however, other types of LEDs can also be used as the light emitting elements. During testing, the power was set at 220 W, with a DC current of 6.0 A and a forward voltage of 41.0 V. Table 1 exhibits all of the data according to the testing in graph 800. The plots in the graph 800 were measured when the LED arrays had been operating at various time intervals between 4 minutes and 5 minutes. The two visible plots in the graph 800 are of the LED arrays emitting 19,500 and 21,250 lumens, with the 21,250 lumen plot having a higher peak radiation flux. As displayed in the figure, the plots experience peaks and valleys in radiation flux as the light emitted increases in wavelength.

TABLE 1

| Time | Lumens | x | y | u' | v' | CCT | Wpeak | CRI | Power | LPW | Voltage | Current |
|---|---|---|---|---|---|---|---|---|---|---|---|---|
| 4:32 | 19500.0 | 0.3433 | 0.3535 | 0.2095 | 0.4853 | 5073 | 453.0 | 74.6 | 191.500 | 101.8 | 38.30 | 5.000 |
| 4:34 | 21240.0 | 0.3433 | 0.3532 | 0.2096 | 0.4852 | 5072 | 453.0 | 74.6 | 214.885 | 98.8 | 39.07 | 5.500 |
| 4:39 | 21250.0 | 0.3434 | 0.3533 | 0.2096 | 0.4852 | 5068 | 453.0 | 74.5 | 218.983 | 97.0 | 39.75 | 5.509 |
| 4:51 | 21250.0 | 0.3433 | 0.3532 | 0.2096 | 0.4852 | 5072 | 453.0 | 74.5 | 218.093 | 97.4 | 39.61 | 5.506 |

Figure 17B:
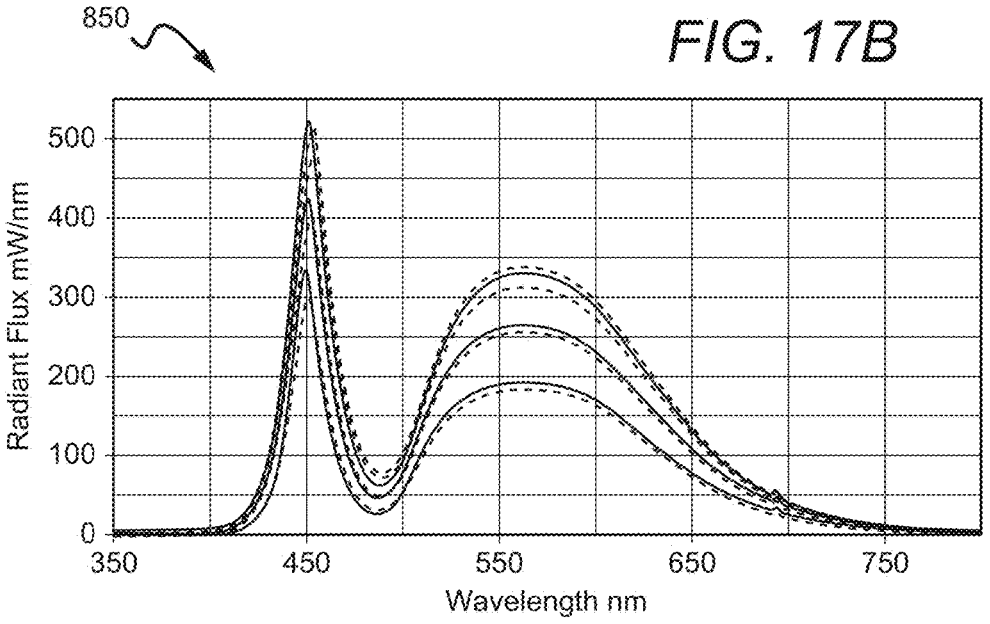
FIG. 17B is another graph charting the relationship between wavelength and radiation flux of light emitting elements according to the present invention.

FIG. 17B is another graph 850 charting the relationship between wavelength and radiation flux of light emitting elements during testing according to the present invention. Just like the previous graph, the graph 850 charts the change in wavelength (nm) of light emitting elements versus the change in radiation flux (mW/nm). Similarly, the light emitting elements used in testing were twelve Cree® XLamp® CXA2520 LED arrays, but other types of LEDs can be used as the light emitting elements. In this test, the power was set at 200 W. Table 2 displays the data according to the testing in graph 850. The plots in the graph 850 were measured when the LED arrays had been operating at various time intervals between 11 minutes and 16 minutes. The plots are measurements of the LED arrays, which were emitting lumen amounts of 11,700, 11,240, 11,180, 16,050, 15,610, 20,060, 18,940, 18,870, 20,510 and 20,120. The 20,060 lumen plot has the highest peak radiation flux. As described above, the plots experience peaks and valleys in radiation flux as the light emitted increases in wavelength.

TABLE 2

| Time | Lumens | x | y | u' | v' | CCT | Wpeak | CRI | Power | LPW | Voltage | PFC |
|---|---|---|---|---|---|---|---|---|---|---|---|---|
| 11:37 | 11700.0 | 0.3487 | 0.3618 | 0.2099 | 0.4901 | 4902 | 449.5 | 72.1 | 102.000 | 114.7 | 120.00 | 0.994 |
| 12:00 | 11240.0 | 0.3474 | 0.3597 | 0.2099 | 0.4889 | 4941 | 450.3 | 73.0 | 98.050 | 114.5 | 120.00 | 0.993 |
| 12:33 | 11180.0 | 0.3471 | 0.3595 | 0.2097 | 0.4888 | 4951 | 450.3 | 73.0 | 97.560 | 114.5 | 120.00 | 0.993 |
| 12:35 | 15050.0 | 0.3453 | 0.3578 | 0.2098 | 0.4878 | 4973 | 450.3 | 73.1 | 150.440 | 106.7 | 120.00 | 0.997 |
| 13:36 | 15610.0 | 0.3452 | 0.3567 | 0.2096 | 0.4871 | 5010 | 452.5 | 73.6 | 148.060 | 105.4 | 120.00 | 0.997 |
| 13:40 | 20060.0 | 0.3454 | 0.3563 | 0.2098 | 0.4870 | 5002 | 450.3 | 73.3 | 200.000 | 100.3 | 120.00 | 0.998 |
| 14:10 | 18940.0 | 0.3435 | 0.3546 | 0.2093 | 0.4859 | 5065 | 453.0 | 74.6 | 187.000 | 95.1 | 120.00 | 0.998 |
| 14:40 | 18870.0 | 0.3433 | 0.3545 | 0.2091 | 0.4859 | 5074 | 453.0 | 74.4 | 196.800 | 95.9 | 120.00 | 0.998 |
| 14:41 | 20510.0 | 0.3432 | 0.3542 | 0.2091 | 0.4856 | 5079 | 453.0 | 74.5 | 220.000 | 93.2 | 120.00 | 0.998 |
| 15:41 | 20120.0 | 0.3424 | 0.3538 | 0.2088 | 0.4853 | 5107 | 453.3 | 74.6 | 219.800 | 91.5 | 120.00 | 0.998 |

Table 3 displays the data according to testing where the power was set at 200 W. Similarly, the light emitting elements used in testing were twelve Cree® XLamp® CXA2520 LED arrays, but other types of LEDs can be used as the light emitting elements. As displayed in FIG. 3, the measurements were taken when the LED arrays had been operating at various time intervals between 3 minutes, 26 seconds and 4 minutes, 26 seconds. The measurements show the LED arrays were emitting lumen amounts of 22,410-25,800. The lumen amounts gradually decreased over the roughly 1 minute of testing.

TABLE 3

| Time | Lumens | x | y | u' | v' | CCT | Wpeak | CRI | Power | LPW | Voltage | Current |
|---|---|---|---|---|---|---|---|---|---|---|---|---|
| 3:26 | 25800.0 | 0.3468 | 0.3569 | 0.2105 | 0.4875 | 4951 | 448.3 | 72.4 | 246.660 | 104.6 | 41.11 | 6.000 |
| 3:31 | 23980.0 | 0.3450 | 0.3547 | 0.2102 | 0.4862 | 5010 | 450.3 | 73.5 | 240.420 | 99.7 | 40.07 | 6.000 |
| 3:36 | 23270.0 | 0.3440 | 0.3540 | 0.2098 | 0.4857 | 5048 | 452.3 | 73.8 | 238.381 | 97.6 | 39.75 | 5.997 |
| 3:41 | 22870.0 | 0.3435 | 0.3535 | 0.2096 | 0.4854 | 5066 | 453.0 | 74.5 | 237.383 | 96.3 | 39.61 | 5.993 |
| 3:46 | 22650.0 | 0.3432 | 0.3531 | 0.2096 | 0.4851 | 5074 | 453.0 | 74.6 | 236.766 | 95.7 | 39.54 | 5.988 |
| 3:51 | 22550.0 | 0.3430 | 0.3529 | 0.2095 | 0.4850 | 5081 | 453.0 | 74.7 | 236.188 | 95.5 | 39.47 | 5.984 |
| 3:56 | 22550.0 | 0.3431 | 0.3529 | 0.2096 | 0.4850 | 5080 | 453.0 | 74.7 | 236.549 | 95.3 | 39.55 | 5.981 |
| 4:06 | 22450.0 | 0.3428 | 0.3528 | 0.2094 | 0.4849 | 5089 | 453.0 | 74.7 | 236.112 | 95.1 | 39.51 | 5.976 |
| 4:16 | 22460.0 | 0.3429 | 0.3526 | 0.2096 | 0.4848 | 5085 | 453.0 | 74.7 | 235.934 | 95.2 | 39.52 | 5.970 |
| 4:26 | 22410.0 | 0.3427 | 0.3526 | 0.2094 | 0.4848 | 5092 | 453.0 | 74.7 | 235.756 | 95.1 | 39.51 | 5.967 |

Figure 18:
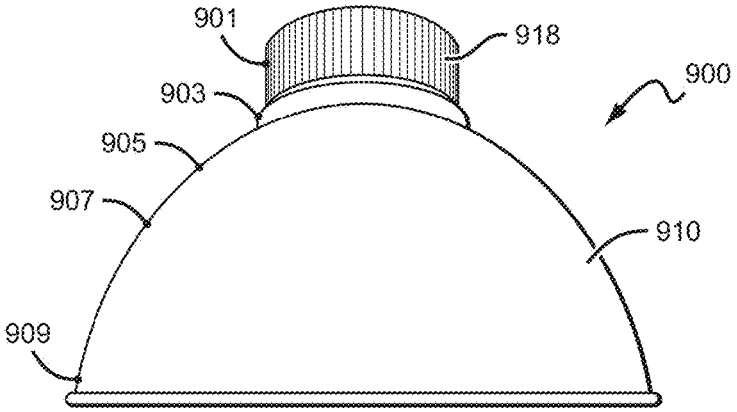
FIG. 18 is a side view of one embodiment of a lighting fixture according to the present invention.

FIG. 18 is a side view of another embodiment of a lighting fixture 900 according to the present invention. The lighting fixture 900 includes a housing 910 and heat fins 918. The heat fins 918 display another manner in which the present invention can dissipate heat. The lighting fixture 900 according to FIG. 18 also includes several references that exhibit a general disparity in temperatures at different points along the lighting fixture 900. The references along with their corresponding case temperature are as follows: 901=51° C., 903=68° C., 905=64° C., 907=44° C. and 909=35° C. These results make sense because the temperature generally increases as the measured portion of the housing 910 gets closer to the light source. The only reference point that has a low temperature relative to its distance from the light source is 901, where the measurement was taken on the heat fins 918. However, this also makes sense because the heat fins 918 are proficient at dissipating heat.

There were also tests performed to measure whether the temperature of the LEDs increased as the wattage was also increased. Table 4 displays one such test, where the power level started at 100.1 W and increased to 235.1 W. As displayed below, as the wattage increased, the corresponding LED temperature increased at an almost linear rate. Furthermore, tests were also performed to determine whether adding slots or openings in the housing would reduce the LED temperature. The results showed that placing nine openings in the housing, where each opening had a diameter of 10 mm, did in fact reduce the LED temperature. Using a wattage of 198.7 W, adding openings in the housing caused the LED temperature to drop to 97.5° C. With a wattage of 218.8 W, the openings caused the LED temperature to drop to 106.7° C. After comparing the results of Table 4, one skilled in the art can ascertain that the openings did make a difference and reduced the LED temperature.

TABLE 4

| Wattage (W) | LED Temperature (° C.) |
|---|---|
| 100.1 W | 59.3° C. |
| 148.1 W | 81.4° C. |
| 180.1 W | 94.9° C. |
| 198.6 W | 102.8° C. |
| 219.9 W | 109.4° C. |
| 235.1 W | 118.0° C. |

The following specifications and dimensions of components can be examples for use in the present invention. The diameter of the light emission end of the housings can be around 16 inches or 400 millimeters, and the housings can be around 2 millimeters thick. The housings can also handle LEDs up to 120 watts, while still maintaining a temperature below 75° C. during environments at room temperature. When LED CXA arrays are used as the light source, as discussed above, the CXAs can have an efficacy of up to 90 lumens/watt. Additionally, the input power to the lighting fixture can be around 120 volts. It is understood that the present invention is not limited by the above specifications and dimensions, so other component specifications and dimensions are acceptable for use in the present invention.

Figure 19:
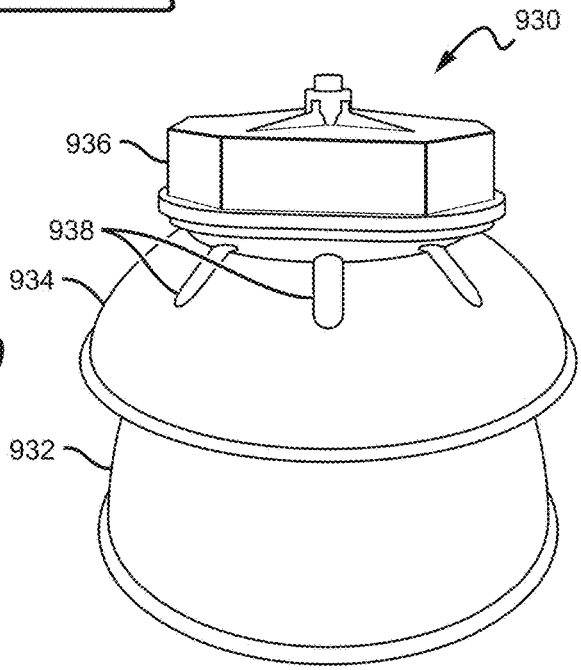
FIG. 19 is a side view of another embodiment of a lighting fixture according to the present invention.

FIG. 19 is a side view of another embodiment of a lighting fixture 930 according to the present invention. The lighting fixture 930 can include a primary housing 932, one or more secondary housings 934, a ballast 936, and slots or openings 938. The ballast 936 can limit current flow to the light source of the lighting fixture 930.

The present invention can also have performance targets for the lighting fixture. Some examples of performance targets can be emissions of 22,000 lumens, a power of 220 W, and a voltage of 120-277V. Additionally, the present invention can target greater than 70 CRI, a light emitting element life span of more than 50,000 hours, a 40 C ambient rating, 4,000K CCT, and a cost of less than $100. Furthermore, the present invention can be designed for integrated occupancy options, have optional dimming, have a surface mount option, and have an HCP and Pendant mount. It is understood that any of the above performance targets or values are not limitations on the present invention, so the lighting fixture can include values not included above or outside of the above ranges.

The present invention can also have different lumen targets and corresponding light emitting element requirements. For example, a target of 10,000-11,000 lumens can require 4 LEDs, such as Cree® XLamp® CXA2530 LEDs, while a target of 22,000 lumens can require 12 LEDs. In addition, the present can also include housings of different sizes and shapes, such as a bell shape. These different housings can have different optical efficiencies, for example 80-85% or any other efficiency value. Also, the light emitting elements driver can have a 90% driver efficiency and have a power of 220 W. Once again, it is understood that any of the above targets or values are not limitations on the present invention, so the present invention can include other target or values.

Figure 20:
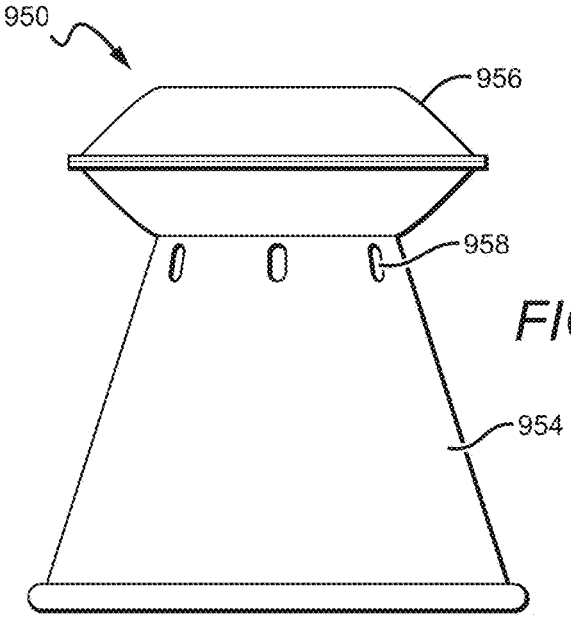
FIG. 20 is a side view of another embodiment of a lighting fixture according to the present invention.

FIG. 20 is a side view of another embodiment of a lighting fixture 950 according to the present invention. The lighting fixture 950 can include one or more secondary housings 954, a driver housing 956, and slots or openings 958. Additionally, the lighting fixture 950 includes a primary housing that is not displayed because it is covered by the one or more secondary housings 954. This embodiment exhibits how a lighting fixture 950 according to the present invention can include multiple housings, yet only appear to have a single housing. It is understood that other embodiments not displayed can also include multiple housings which appear to be a single housing.

Figure 21:
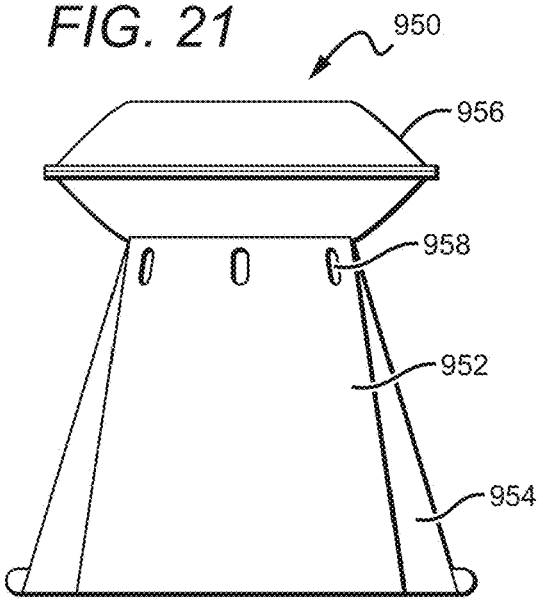
FIG. 21 is a sectional view of another embodiment of a lighting fixture according to the present invention.

FIG. 21 is a sectional view of the lighting fixture 950 according to the present invention. As depicted in FIG. 21, the lighting fixture 950 can comprise a primary housing 952, one or more secondary housings 954, a driver housing 956, and slots or openings 958. FIG. 21 shows that the one or more secondary housings 954 can be covering the primary housing 952, so that the lighting fixture 950 appears to have a single housing.

Figure 22:
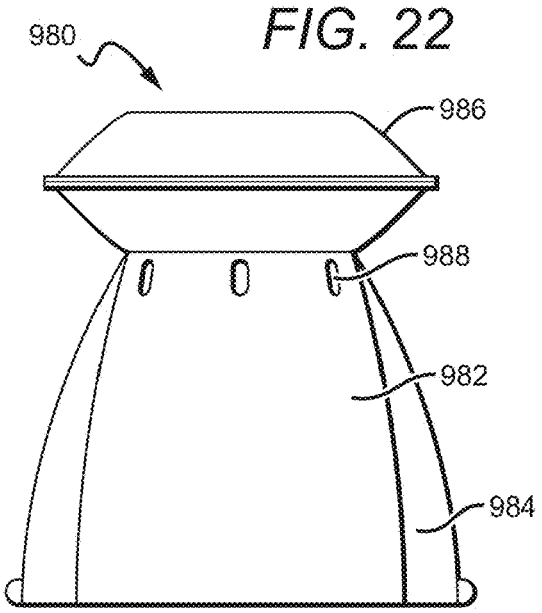
FIG. 22 is a sectional view of another embodiment of a lighting fixture according to the present invention.

FIG. 22 is a sectional view of another embodiment of a lighting fixture 980 according to the present invention. The lighting fixture 980 can comprise a primary housing 982, one or more secondary housings 984, a driver housing 986, and slots or openings 988. FIG. 22 also shows that the one or more secondary housings 984 are covering the primary housing 982, so that the lighting fixture 980 appears to have a single housing. Additionally, FIG. 22 exhibits how the primary housing 982 and one or more secondary housings 984 can have different dimensions, such as being wider and more curved. It is understood that other embodiments of the present invention can have differently shaped housings.

Figure 23:
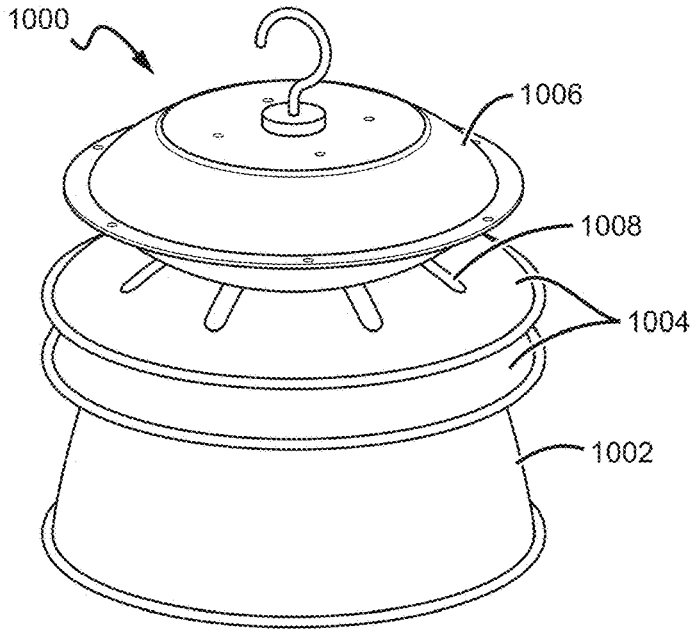
FIG. 23 is a perspective view of another embodiment of a lighting fixture according to the present invention.

FIGS. 23 and 24 display embodiments that use different housing formations according to the present invention. FIG. 23 is a perspective view of an embodiment of a lighting fixture 1000 according to the present invention. The lighting fixture 1000 can include a primary housing 1002, one or more secondary housings 1004, a driver housing 1006, and slots or openings 1008. FIG. 23 exhibits that there are two separate secondary housings 1004, but it is understood that there can be more than two secondary housings 1004. Therefore, FIG. 23 displays one example of the appearance of a lighting fixture 1000 according to the present invention with multiple secondary housings.

Additionally, FIG. 24 is a perspective view of an embodiment of a lighting fixture 1050 according to the present invention. The lighting fixture 1050 can include a primary housing 1052, one or more secondary housings 1054, and slots or openings 1058. The one or more secondary housings 1054 in the present embodiment can be shaped somewhat like an inverted primary housing 1052. However, it is understood that the one or more secondary housings 1054 can embody numerous other shapes. This embodiment exhibits that lighting fixtures according to the present invention can have multiple housings that extend in the same direction, the opposite direction, or any direction with respect to one another.

FIG. 25 displays another embodiment of a lighting fixture 1100 according to the present invention. The lighting fixture 1100 can include a primary housing 1102, one or more secondary housings 1104, a driver housing 1106, and slots or openings 1108. As exhibited in FIG. 25, the driver housing 1106 can comprise spun aluminum; however, the driver housing 1106 can be made of any other material mentioned herein. Additionally, the driver housing 1106 may be referred to as a driver box.

FIG. 26 is a perspective view of another embodiment of a lighting fixture 1150 according to the present invention. As displayed in the embodiment, the lighting fixture 1150 can include a primary housing 1152, one or more secondary housings 1154, slots or openings 1158, and heat fins 1168. The heat fins 1168 are located above the one or more secondary housings 1154, so that they are in close proximity to the light sources. As such, this embodiment exhibits that lighting fixtures according to the present invention can use heat fins to dissipate heat from the light sources. Although the heat fins 1168 are located on top of the one or more secondary housings 1158, it is understood that the heat fins 1168 can be located anywhere within the lighting fixture 1150.

FIG. 27 is a bottom perspective view of another embodiment of a lighting fixture 1200 according to the present invention. The lighting fixture 1200 can include a primary housing 1202, a driver housing 1206, and a lens cover 1214. As displayed in the embodiment, the primary housing 1202 has a square shape, but it can also be rectangular, triangular, pentagonal, hexagonal, or octagonal. Furthermore, the primary housing 1202, or any other housing according to the present invention, can comprise any geometric shape. Therefore, this embodiment displays that the housings according to the present invention can take on any number of different shapes or sizes. Furthermore, the bottom edge of the housings does not need to be a continuous and/or uniform edge.

Figure 28:
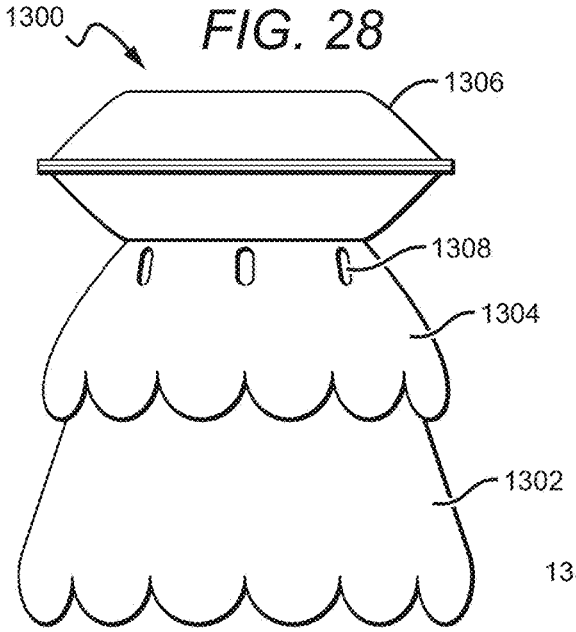
FIG. 28 is a side perspective view of another embodiment of a lighting fixture according to the present invention.

FIG. 28 is a side view of another embodiment of a lighting fixture 1300 according to the present invention. The lighting fixture 1300 can include a primary housing 1302, one or more secondary housings 1304, a driver housing 1306, and slots or openings 1308. The primary housing 1306 and one or more secondary housings 1304 can have curved or decorative shapes. This embodiment exhibits that the present invention can have housings or other components that are decorative. It is understood that other embodiments of the present invention can have housings or components shaped in a different decorative manner.

Figure 29:
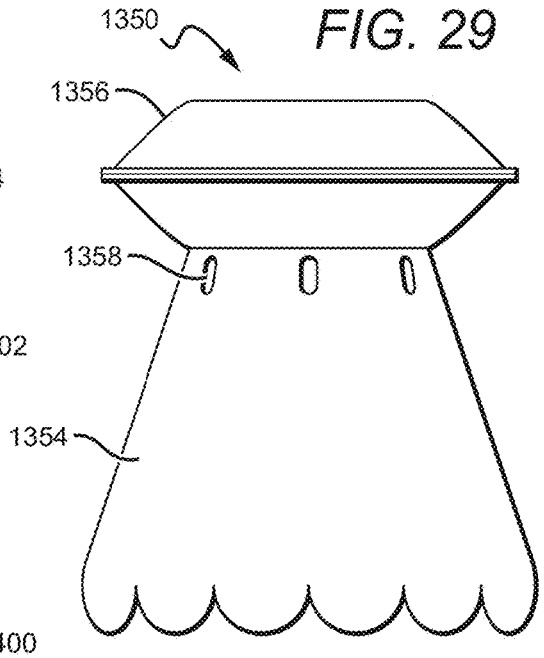
FIG. 29 is a side perspective view of another embodiment of a lighting fixture according to the present invention.

FIG. 29 is a side view of another embodiment of a lighting fixture 1350 according to the present invention. The lighting fixture 1350 can include one or more secondary housings 1354, a driver housing 1356, and slots or openings 1358. As mentioned above, the one or more secondary housings 1354 can have curved or decorative shapes. The one or more secondary housings 1354 can also be covering a primary housing. This embodiment displays that the present invention can have multiple housings that are decorative, but also only appear to have a singular housing.

Figure 30:
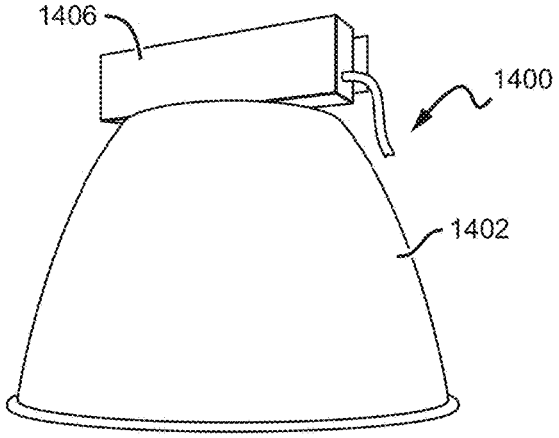
FIG. 30 is a side perspective view of another embodiment of a lighting fixture according to the present invention.

FIG. 30 is a side view of another embodiment of a lighting fixture 1400 according to the present invention. The lighting fixture 1400 can include a housing 1402 and a ballast 1406. This embodiment exhibits yet another type of lighting fixture that can be used in the present invention.

Figure 31A:
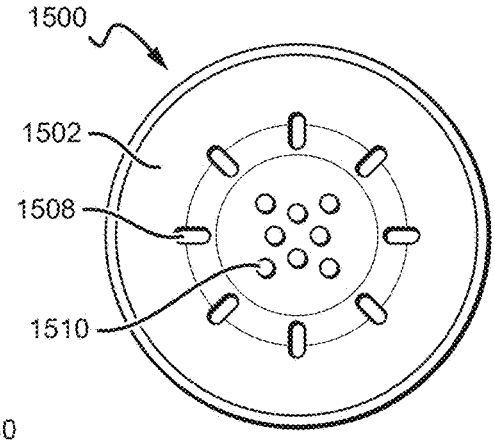
FIG. 31A is a view of one embodiment of a lighting fixture according to the present invention.

FIG. 31A is a view of one embodiment of a lighting fixture 1500 according to the present invention. As displayed in FIG. 31A, the lighting fixture 1500 can comprise a primary housing 1502, slots or openings 1508, and one or more light emitting elements 1510. FIG. 31A exhibits a way of managing the thermal output of multiple light emitting elements 1510. Specifically, FIG. 31A shows there can be 8 individuals light emitting elements 1510, and each can have a diameter of 20 millimeters. In this example, the area of the light emitting devices can be calculated by the formula $a=8\pi r^2$. In this example, the calculation is as follows: $a=8\pi 10^2=2513\ mm^2$. One way to account for the thermal management of the devices is to calculate the circumference, which can be determined by the formula $C=8\pi D$. In this example, the calculation is as follows: $C=8\pi 20=502.6$ mm. However, in actuality, the circumference of the light emitting devices is not always calculated by this formula. This is because the calculation also depends on the shape of the light emitting devices and the distance between each individual light emitting element.

Figure 31B:
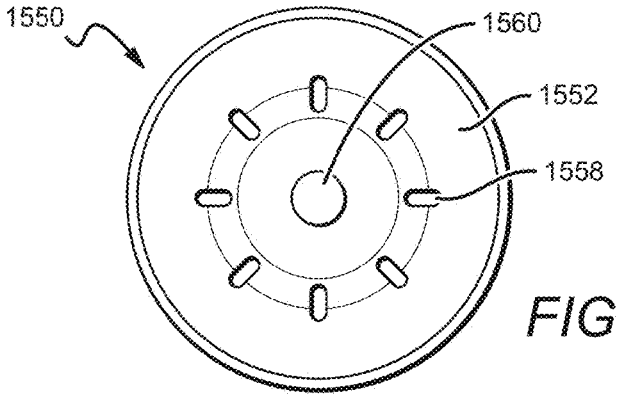
FIG. 31B is a view of another embodiment of a lighting fixture according to the present invention.

FIG. 31B is a view of another embodiment of a lighting fixture 1550 according to the present invention. As displayed in FIG. 31B, the lighting fixture 1550 can comprise a primary housing 1552, slots or openings 1558, and one or more light emitting elements 1560. FIG. 31B exhibits a way to manage the thermal output of a single light emitting element 1560. Specifically, FIG. 31B shows there can be one individual light emitting element 1560, and it can have a diameter of 56.6 millimeters. This diameter is an assumption for calculation purposes, so that the single light emitting element in FIG. 31B will have the same surface area as the 8 light emitting elements in FIG. 31A. The area of the light emitting element 690 is $a=\pi r^2=\pi(28.3)^2=2513\ mm^2$. However, the circumference of the individual light emitting element 1560 is much smaller at $C=\pi(56.6)=177.8$ mm. Although the surface areas of the 8 light emitting elements and 1 light emitting element can be the same, this calculation shows that their circumferences can be vastly different, which can alter the thermal management for each lighting fixture.

FIGS. 32A, 32B, 33A, 33B, 34A, and 34B are color drawings that display thermal measurements of different embodiments of the present invention. The color drawings are necessary as the only practical medium by which aspects of the drawings may be accurately conveyed. Because the different colors represent different temperatures, color is necessary to convey the significance of each drawing. A petition to file color drawings is submitted herewith.

Figure 32A:
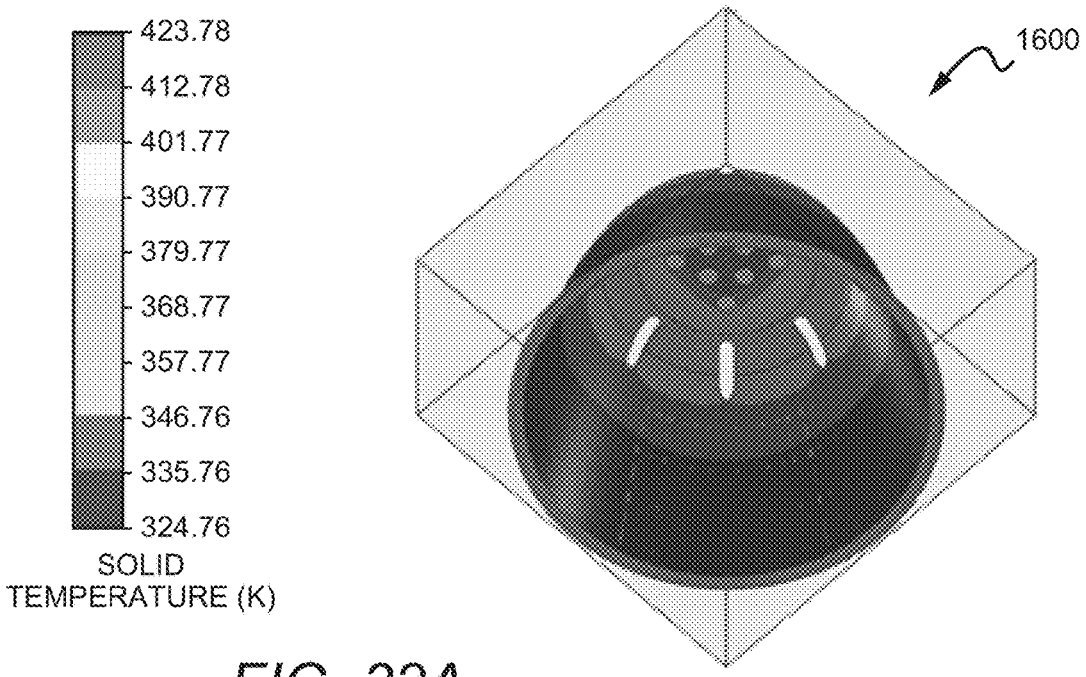
FIG. 32A is a thermal view of one embodiment of a lighting fixture according to the present invention.
Figure 32B:
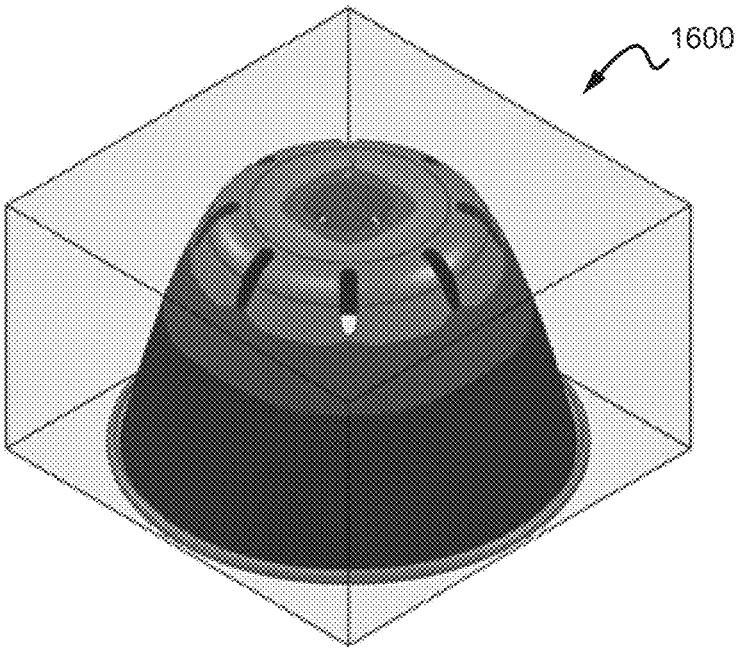
FIG. 32B is a thermal view of one embodiment of a lighting fixture according to the present invention.

FIG. 32A is a top thermal view of one embodiment of a lighting fixture 1600 according to the present invention, while FIG. 32B is a bottom thermal view of the same embodiment. The lighting fixture 1600 can comprise 8 light emitting elements, each with an individual power of 20 W. Therefore, the total power of the light source of the lighting fixture 1600 is 160 W. In this embodiment, the thickness of the spun housing is 2 mm. As shown by the temperature graph, the maximum temperature of lighting fixture 1600 is 423.78K.

Figure 33A:
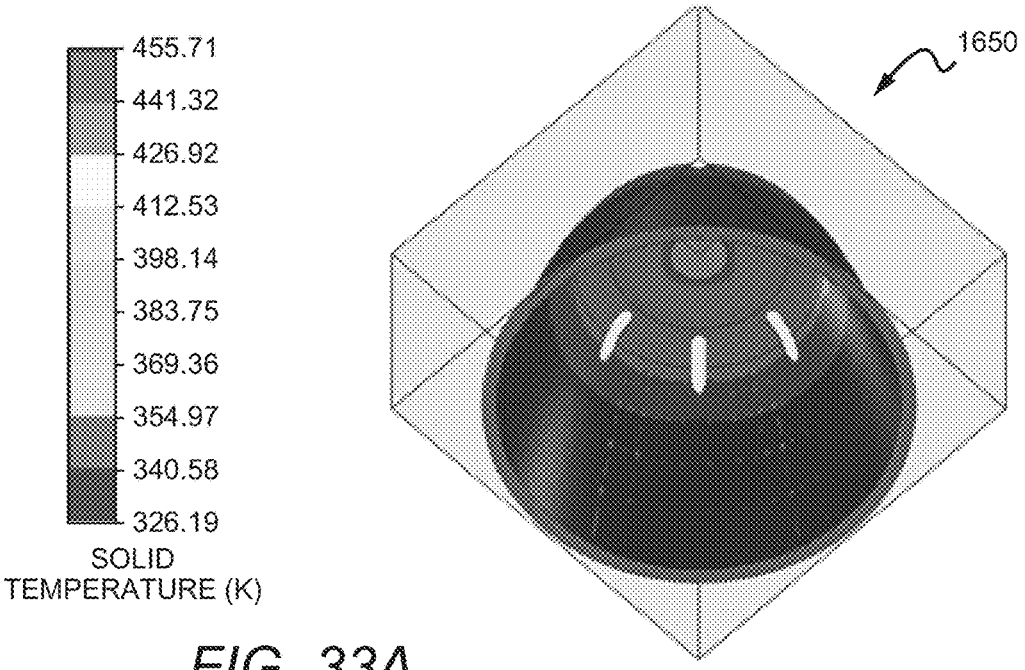
FIG. 33A is a thermal view of one embodiment of a lighting fixture according to the present invention.
Figure 33B:
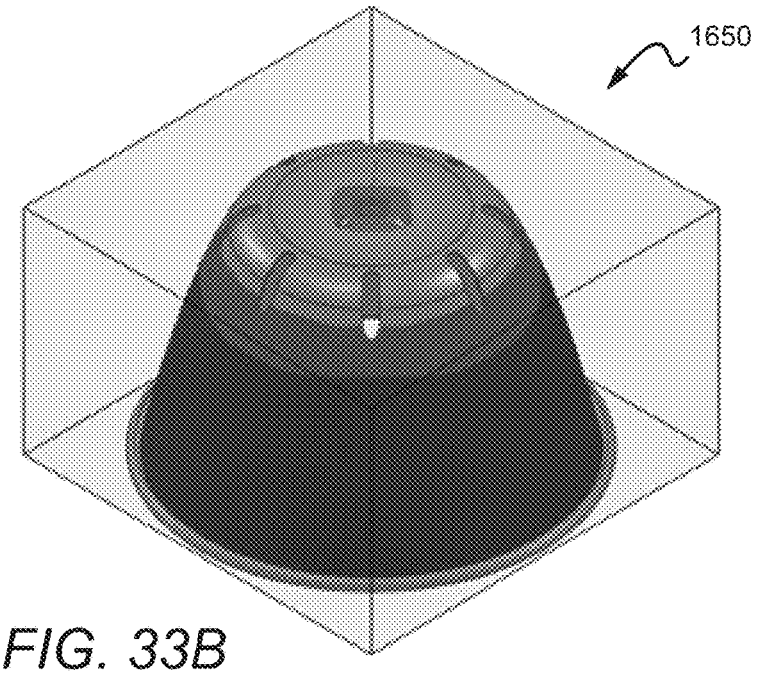
FIG. 33B is a thermal view of one embodiment of a lighting fixture according to the present invention.

FIG. 33A is a top thermal view of one embodiment of a lighting fixture 1650 according to the present invention, while FIG. 33B is a bottom thermal view of the same embodiment. The lighting fixture 1650 can comprise 1 individual light emitting element with a power of 160 W. Thus, the total power of the light source of lighting fixture 1650 is also 160 W. In this embodiment, the thickness of the spun housing is also 2 mm. As shown by the temperature graph, the maximum temperature of lighting fixture 1650 is 455.71K.

The thermal graphs of FIGS. 32A and 32B with the 8 light emitting elements spread out have a relatively low overall temperature, while the thermal graphs of FIGS. 33A and 33B with 1 individual light emitting element have a higher overall temperature. Therefore, these thermal calculations show that separating the light emitting elements can lower the junction temperature of the light emitting elements, as well as improve heat transfer to the housings. Furthermore, the above thermal calculation results display that the junction temperature can be lowered.

Figure 34A:
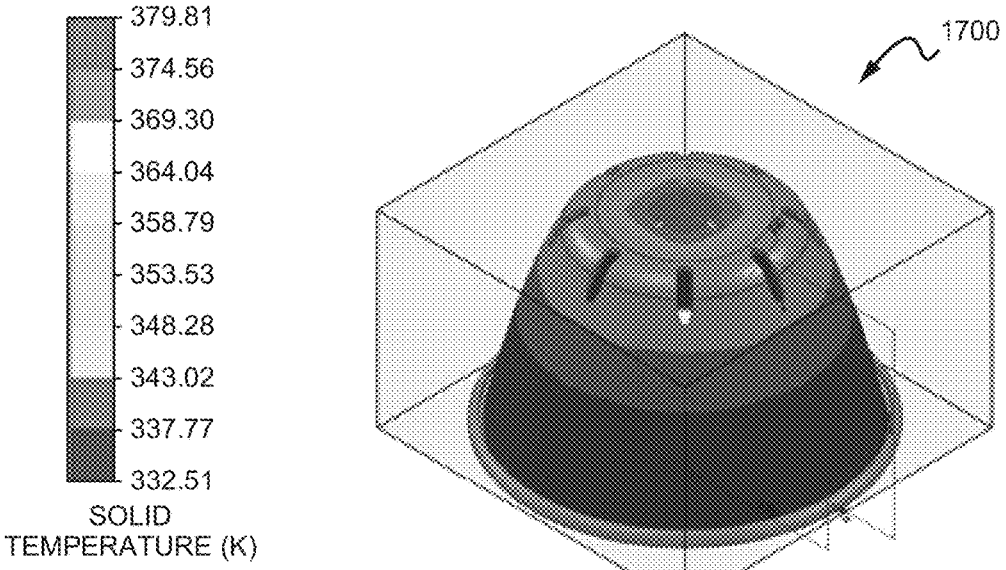
FIG. 34A is a thermal view of one embodiment of a lighting fixture according to the present invention.

FIG. 34A is a top thermal view of another embodiment of a lighting fixture 1700 according to the present invention. The lighting fixture 1700 has a spun housing thickness of 5 mm with a maximum temperature of 379.81K. This embodiment shows that by thickening the spun housing, the heat dissipation of the housing can improve. However, it is difficult and expensive to spin aluminum housings that have thicknesses of 5 mm.

Figure 34B:
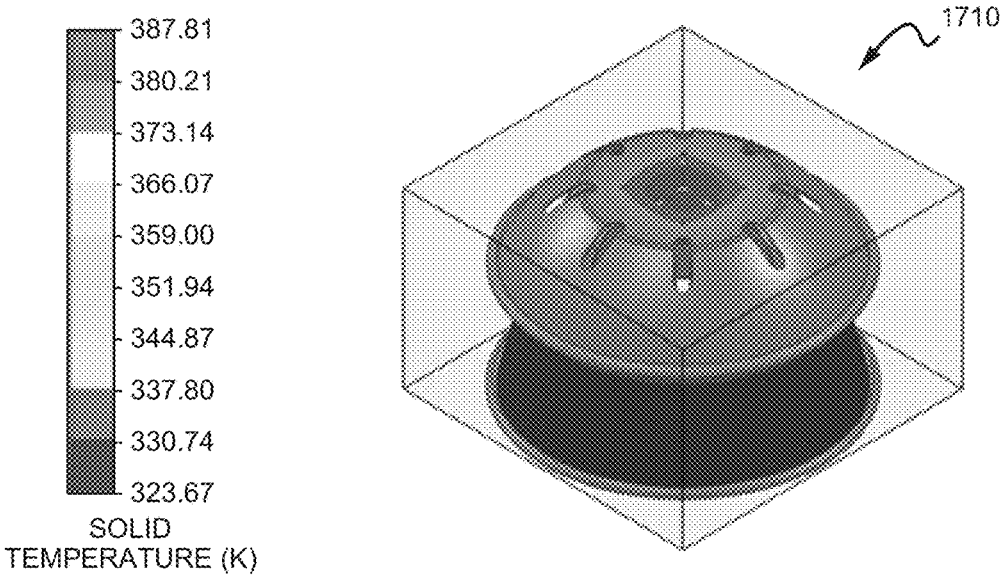
FIG. 34B is a thermal view of one embodiment of a lighting fixture according to the present invention.

FIG. 34B is a top thermal view of another embodiment of a lighting fixture 1710 with multiple housings. The lighting fixture 1710 has spun housings with a thickness of 2 mm and a maximum temperature of 387.27K. This embodiment shows that adding multiple housings can also improve heat dissipation, while keeping the cost low compared to a single thicker housing.

FIGS. 35A and 35B display one embodiment of an optical design according to the present invention. FIG. 35A is a perspective view an optical design 1750. Optical design 1750 can comprise light emitting elements 1752, a light emitting element cover 1754, and a transparent lens cover 1756. FIG. 35B is a light distribution plot 1760 of the optical design 1750. The light distribution plot 1760 shows luminous intensity (in candelas) at different observation angles. The observation at 0 degrees, or straight below the lighting fixture, is the maximum luminous intensity, while the observation at offset angles has a gradually lower intensity. According to the light distribution plot 1760, the total collected lumens are 26,827, the efficiency is 0.89425, and the maximum intensity is 9,515.7 candelas. Additionally, the achievable spacing of the optical design 1750 is 1.3-1.4. The estimated optical efficiency is around 83%, which is 2% below the target of 85% optical efficiency. However, it is understood that these are only some examples of targets and values that can be used in the present invention.

FIGS. 36A and 36B exhibit another embodiment of an optical design according to the present invention. FIG. 36A is a perspective view an optical design 1800. Optical design 1800 can comprise light emitting elements 1802, a light emitting element cover 1804, a transparent lens cover 1806, and a reflector cone 1808. The reflector cone 1808 can comprise a highly reflective material, such as a polycarbonate. FIG. 36B is a light distribution plot 1810 of the optical design 1800. As stated above, the light distribution plot 1810 shows luminous intensity (in candelas) at different observation angles. With the addition of the reflector cone 1808, the light distribution can be spread out which allows for increased spacing between lighting fixtures. According to the light distribution plot 1810, the total collected lumens are 24,154, the efficiency is 0.80615, and the maximum intensity is 7,497.5 candelas. Also, the achievable spacing of the optical design 1800 is 1.7. The estimated optical efficiency is approximately 75%, which is 10% below the previously mentioned target of 85% optical efficiency.

FIGS. 37A and 37B show yet another embodiment of an optical design according to the present invention. FIG. 37A is a perspective view an optical design 1850. Optical design 1850 can comprise light emitting elements 1852, a light emitting element cover 1854, a transparent lens cover 1856, and a reflector cone 1858. The reflector cone 1858 can comprise a highly reflective material, such as a polycarbonate. In some embodiments, as displayed by FIG. 37A, the light emitting elements 1852 can be placed at an angle. FIG. 37B is a light distribution plot 1860 of the optical design 1850. As previously stated, the light distribution plot 1860 shows luminous intensity (in candelas) at different observation angles. With the addition of the reflector cone 1858, and positioning the light emitting elements 1852 at an outward-facing angle, the light distribution can be spread out which allows for increased spacing between lighting fixtures. According to the light distribution plot 1860, the total collected lumens are 23,627, the efficiency is 0.78423, and the maximum intensity is 6,768.8 candelas. Furthermore, the achievable spacing of the optical design 1850 is 1.7. The estimated optical efficiency is approximately 75%, which is also 10% below the aforementioned target of 85% optical efficiency.

FIG. 38 is a perspective view of yet another embodiment of an optical design 1900 according to the present invention. Optical design 1900 can comprise light emitting elements 1902 and a transparent lens cover 1904. In some embodiments, as displayed by FIG. 38, the light emitting elements 1902 can be placed at an angle. By positioning the light emitting elements 1902 at an inward-facing angle, the light distribution can be spread out which allows for increased spacing between lighting fixtures. Optical design 1900 can also comprise heat fins which can help to more easily dissipate heat from the light emitting elements 1902. Additionally, optical design 1900 can comprise slots or openings and/or air vents which can help air flow through the optical design and/or more easily dissipate heat from the light emitting elements 1902.

FIG. 39 is a perspective view of another embodiment of an optical design 2000 according to the present invention. FIG. 39 displays that the optical design 2000 can include a profiled lens 2050, a transparent glass lens cover 2054, and a reflector 2056. Optical design 2000 also includes several components which are not seen, such as light emitting elements and a light emitting elements cover which can be over a heat transfer device. The reflector 2056 can comprise a highly reflective material, so that it can cut off and redirect wide angled light beams. FIGS. 39A, 39B, and 39C are sectional views of the lens 2050. With the features of the lens 2050 displayed in FIGS. 39A, 39B, and 39C, the light distribution can be spread out which allows for increased spacing between lighting fixtures. FIG. 390 is a dimensional graph 2060 of the lens 2050.

FIG. 40A is a light distribution plot 2100 for the optical design 2000 according to the present invention. The light distribution plot 2100 displays the light distribution of the optical design 2000 without using a reflector. Table 5 displays characteristics of the light distribution plot 2100. Also, the light distribution plot 2100 exhibits there can be no luminescence (candelas/$m^2$) from 45° to 85°.

TABLE 5

| Characteristics | |
|---|---|
| Lumens Per Lamp | 2500 (12 lamps) |
| Total Lamp Lumens | 30000 |
| Luminaire Lumens | 24877 |
| Total Luminaire Efficiency | 83% |
| Luminaire Efficacy Rating (LER) | 24877 |
| Total Luminaire Watts | 1 |
| Ballast Factor | 1.00 |
| CIE Type | Direct |
| Spacing Criterion (0-180) | 1.86 |
| Spacing Criterion (90-270) | 1.86 |
| Spacing Criterion (Diagonal) | 1.80 |
| Basic Luminous Shape | Point |
| Luminous Length (0-180) | 0.00 m |
| Luminous Width (90-270) | 0.00 m |
| Luminous Height | 0.00 m |

FIG. 40B is another light distribution plot 2150 for the optical design 2000. The light distribution plot 2100 displays the light distribution of the optical design 2000 with the reflector 2056. The light distribution plot 2150 shows that the reflector 2056 can cut off and redirect wide angled light beams. Table 6 exhibits characteristics of the light distribution plot 2150. Furthermore, the light distribution plot 2150 displays there can be no luminescence (candelas/$m^2$) from 45° to 85°.

TABLE 6

| Characteristics | |
|---|---|
| Lumens Per Lamp | 2500 (12 lamps) |
| Total Lamp Lumens | 30000 |
| Luminaire Lumens | 23966 |
| Total Luminaire Efficiency | 80% |
| Luminaire Efficacy Rating (LER) | 23966 |
| Total Luminaire Watts | 1 |
| Ballast Factor | 1.00 |
| CIE Type | Direct |
| Spacing Criterion (0-180) | 1.68 |
| Spacing Criterion (90-270) | 1.68 |
| Spacing Criterion (Diagonal) | 1.68 |
| Basic Luminous Shape | Point |
| Luminous Length (0-180) | 0.00 m |
| Luminous Width (90-270) | 0.00 m |
| Luminous Height | 0.00 m |

It is understood that embodiments presented herein are meant to be exemplary. Embodiments of the present invention can comprise any combination of compatible features shown in the various figures, and these embodiments should not be limited to those expressly illustrated and discussed.

Although the present invention has been described in detail with reference to certain configurations thereof, other versions are possible. Therefore, the spirit and scope of the invention should not be limited to the versions described above.

The foregoing is intended to cover all modifications and alternative constructions falling within the spirit and scope of the invention as expressed in the appended claims, wherein no portion of the disclosure is intended, expressly or implicitly, to be dedicated to the public domain if not set forth in the claims.

We claim:

1. A lighting fixture, comprising:

a plurality of light emitting elements;

a primary housing in thermal contact with said plurality of light emitting elements, wherein said primary housing dissipates at least some heat produced by said plurality of light emitting elements, said primary housing comprising slots or openings configured to allow at least some light from said plurality of light emitting elements to emit in a direction opposite the majority of light emitted from said plurality of light emitting elements; and a heat transfer device in thermal contact with said plurality of light emitting elements, wherein said heat transfer device transmits at least some heat produced by said plurality of light emitting elements.

2. The lighting fixture of claim 1, wherein said plurality of light emitting elements are on said heat transfer device.

3. The lighting fixture of claim 1, wherein said heat transfer device is in thermal contact with said primary housing, such that said heat transfer device transmits at least some heat produced by said plurality of light emitting elements to said primary housing.

4. The lighting fixture of claim 1, wherein said slots or openings facilitate heat dissipation.

5. The lighting fixture of claim 1, further comprising a light emitting elements holder on said plurality of light emitting elements.

6. The lighting fixture of claim 1, further comprising a lens over said plurality of light emitting elements.

7. The lighting fixture of claim 1, further comprising one or more heat fins on said primary housing and in thermal contact with said plurality of light emitting elements, wherein said one or more heat fins dissipate at least some heat produced by said plurality of light emitting elements.

8. The lighting fixture of claim 1, wherein at least two of said plurality of light emitting elements are electrically interconnected.

9. The lighting fixture of claim 1, wherein all of said plurality of light emitting elements are electrically interconnected, so that the failure of any individual said plurality of light emitting elements does not affect any other said plurality of light emitting elements.

10. The lighting fixture of claim 1, wherein said plurality of light emitting elements are on a substrate.

11. The lighting fixture of claim 1, wherein said plurality of light emitting elements are light emitting diodes (LEDs).

12. The lighting fixture of claim 1, wherein said heat transfer device is a plate or column.

13. The lighting fixture of claim 1, wherein each individual said plurality of light emitting elements are spread apart from the other said plurality of light emitting elements.

14. The lighting fixture of claim 13, wherein spreading apart said plurality of light emitting elements facilitates the dissipation of heat from said plurality of light emitting elements.

15. The lighting fixture of claim 1, further comprising one or more secondary housings in thermal contact with said plurality of light emitting elements, wherein said one or more secondary housings dissipate at least some heat produced by said plurality of light emitting elements.

16. The lighting fixture of claim 15, wherein said heat transfer device is in thermal contact with said one or more secondary housings, such that said heat transfer device transmits at least some heat produced by said plurality of light emitting elements to said one or more secondary housings.

17. The lighting fixture of claim 15, wherein said one or more secondary housings include slots or openings to facilitate heat dissipation.

18. The lighting fixture of claim 15, wherein said one or more secondary housings overlap said primary housing to create the appearance of a singular housing.

19. The lighting fixture of claim 15, wherein at least one of said primary housing and said one or more secondary housings comprises a geometrical shape.

20. The lighting fixture of claim 15, wherein at least one of said heat transfer device, said primary housing, and said one or more secondary housings comprises one or more of the following materials: aluminum, steel, zinc, copper, tin, ceramic, glass, or a thermally conductive plastic.

21. The lighting fixture of claim 1, further comprising a driver housing in thermal contact with said plurality of light emitting elements, wherein said driver housing dissipates at least some heat produced by said plurality of light emitting elements.

22. The lighting fixture of claim 21, wherein said heat transfer device is in thermal contact with said driver housing, such that said heat transfer device transmits at least some heat produced by said plurality of light emitting elements to said driver housing.

23. The lighting fixture of claim 21, wherein said driver housing is on said primary housing.

24. The lighting fixture of claim 21, wherein said driver housing includes slots or openings to facilitate heat dissipation.

25. The lighting fixture of claim 24, wherein said slots or openings in said driver housing allow at least some light from said plurality of light emitting elements to emit in a direction opposite the majority of light emitted from said plurality of light emitting elements.

26. A lighting fixture, comprising:

a plurality of light emitting elements;

a primary housing in thermal contact with said plurality of light emitting elements, wherein said primary housing dissipates at least some heat produced by said plurality of light emitting elements; and one or more secondary housings in thermal contact with said plurality of light emitting elements, wherein said one or more secondary housings dissipate at least some heat produced by said plurality of light emitting elements, said one or more secondary housings comprising slots or openings, wherein said slots or openings in said one or more secondary housings allow at least some light from said plurality of light emitting elements to emit in a direction opposite the majority of light emitted from said plurality of light emitting elements.

27. A lighting fixture, comprising:

one or more light emitting elements;

a primary housing in thermal contact with said one or more light emitting elements, wherein said primary housing dissipates at least some heat produced by said one or more light emitting elements; and one or more secondary housings in thermal contact with said one or more light emitting elements, wherein said one or more secondary housings dissipate at least some heat produced by said one or more light emitting elements, wherein at least one of said one or more secondary housings at least partially surrounds said primary housing;

wherein said primary housing includes slots or openings to facilitate heat dissipation, wherein said slots or openings in said primary housing allow at least some light from said one or more light emitting elements to emit in a direction opposite the majority of light emitted from said one or more light emitting elements.

28. A lighting fixture, comprising:

one or more light emitting elements;

a primary housing in thermal contact with said one or more light emitting elements, wherein said primary housing dissipates at least some heat produced by said one or more light emitting elements; and one or more secondary housings in thermal contact with said one or more light emitting elements, wherein said one or more secondary housings dissipate at least some heat produced by said one or more light emitting elements, wherein at least one of said one or more secondary housings at least partially surrounds said primary housing;

wherein said one or more secondary housings include slots or openings to facilitate heat dissipation, wherein said slots or openings in said one or more secondary housings allow at least some light from said one or more light emitting elements to emit in a direction opposite the majority of light emitted from said one or more light emitting elements.

29. A lighting fixture, comprising:

one or more light emitting elements;

a primary housing in thermal contact with said one or more light emitting elements, wherein said primary housing dissipates at least some heat produced by said one or more light emitting elements;

one or more secondary housings in thermal contact with said one or more light emitting elements, wherein said one or more secondary housings dissipate at least some heat produced by said one or more light emitting elements, wherein at least one of said one or more secondary housings at least partially surrounds said primary housing; and a driver housing in thermal contact with said one or more light emitting elements, wherein said driver housing dissipates at least some heat produced by said one or more light emitting elements;

wherein said driver housing includes slots or openings to facilitate heat dissipation, wherein said slots or openings in said driver housing allow at least some light from said one or more light emitting elements to emit in a direction opposite the majority of light emitted from said one or more light emitting elements.

30. A lighting fixture, comprising:

one or more light emitting elements;

a primary housing in thermal contact with said one or more light emitting elements, a portion of said primary housing extending a length in the same direction as the majority of light emitted from said fixture; and a secondary housing in thermal contact with said one or more light emitting elements, said secondary housing defining an open end, wherein said secondary housing comprises a portion extending a length in the same direction as the majority of light emitted from said fixture and at least partially overlaps and surrounds less than all of said primary housing, such that the space between said primary housing and said secondary housing open end is unobstructed, wherein said portion of said primary housing extending a length in the same direction as the majority of light emitted from said fixture comprises a greater length than said portion of said secondary housing open end extending in the same direction as the majority of light emitted from said fixture, and wherein a shortest direct distance from a distal end of said primary housing to said one or more light emitting elements is greater than a shortest direct distance from a distal end of said secondary housing to said one or more light emitting elements.

31. The lighting fixture of claim 30, further comprising a lens over said one or more light emitting elements, wherein said portion of said primary housing extending a length in the same direction as the majority of light emitted from said fixture extends past and at least partially surrounds said lens.

32. The lighting fixture of claim 30, wherein said primary housing includes slots or openings to facilitate heat dissipation.

33. The lighting fixture of claim 30, wherein said secondary housing include slots or openings to facilitate heat dissipation.

34. The lighting fixture of claim 30, further comprising a light emitting elements holder on said one or more light emitting elements.

35. The lighting fixture of claim 30, further comprising a lens over said one or more light emitting elements.

36. The lighting fixture of claim 30, further comprising one or more heat fins on said primary housing and in thermal contact with said one or more light emitting elements, wherein said one or more heat fins dissipate at least some heat produced by said one or more light emitting elements.

37. The lighting fixture of claim 30, wherein at least two of said one or more light emitting elements are electrically interconnected.

38. The lighting fixture of claim 30, wherein all of said one or more light emitting elements are electrically interconnected, so that the failure of any individual said one or more light emitting elements does not affect any other said one or more light emitting elements.

39. The lighting fixture of claim 30, wherein said one or more light emitting elements are on a substrate.

40. The lighting fixture of claim 30, wherein said one or more light emitting elements are light emitting diodes (LEDs).

41. The lighting fixture of claim 30, wherein said secondary housing overlaps said primary housing to create the appearance of a singular housing.

42. The lighting fixture of claim 30, wherein at least one of said primary housing and said secondary housing comprises a geometrical shape.

43. The lighting fixture of claim 30, wherein each individual said one or more light emitting elements are spread apart from the other said one or more light emitting elements.

44. The lighting fixture of claim 43, wherein spreading apart said one or more light emitting elements facilitates the dissipation of heat from said one or more light emitting elements.

45. The lighting fixture of claim 30, further comprising a driver housing in thermal contact with said one or more light emitting elements, wherein said driver housing dissipates at least some heat produced by said one or more light emitting elements.

46. The lighting fixture of claim 45, wherein a heat transfer device is in thermal contact with said driver housing, such that said heat transfer device transmits at least some heat produced by said one or more light emitting elements to said driver housing.

47. The lighting fixture of claim 45, wherein said driver housing is on said primary housing.

48. The lighting fixture of claim 45, wherein said driver housing includes slots or openings to facilitate heat dissipation.

49. The lighting fixture of claim 30, further comprising a heat transfer device in thermal contact with said one or more light emitting elements, wherein said heat transfer device transmits at least some heat produced by said one or more light emitting elements.

50. The lighting fixture of claim 49, wherein said heat transfer device is in thermal contact with said primary housing, such that said heat transfer device transmits at least some heat produced by said one or more light emitting elements to said primary housing.

51. The lighting fixture of claim 49, wherein said heat transfer device is in thermal contact with said secondary housing, such that said heat transfer device transmits at least some heat produced by said one or more light emitting elements to said secondary housing.

52. The lighting fixture of claim 49, wherein said heat transfer device is a plate or column.

53. The lighting fixture of claim 49, wherein at least one of said heat transfer device, said primary housing, and said secondary housing comprises one or more of the following materials: aluminum, steel, zinc, copper, tin, ceramic, glass, or a thermally conductive plastic.

* * * * *